US006171768B1

(12) United States Patent
Haraga et al.

(10) Patent No.: US 6,171,768 B1
(45) Date of Patent: Jan. 9, 2001

(54) IMAGE FORMING METHOD

(75) Inventors: Hideaki Haraga; Kuniaki Uezawa, both of Hino (JP)

(73) Assignee: Konica Corporation, Tokyo (JP)

( * ) Notice: Under 35 U.S.C. 154(b), the term of this patent shall be extended for 0 days.

(21) Appl. No.: 09/187,779

(22) Filed: Nov. 6, 1998

(30) Foreign Application Priority Data

Nov. 11, 1997 (JP) ..... 9-308669

(51) Int. Cl.[7] ..... G03C 7/18
(52) U.S. Cl. ..... 430/362; 430/357
(58) Field of Search ..... 430/357, 362

(56) References Cited

U.S. PATENT DOCUMENTS

| | | | |
|---|---|---|---|
| 4,178,183 | 12/1979 | Ciurca, Jr. et al. | 430/553 |
| 4,717,952 | 1/1988 | Kohayakawa et al. | 538/113 |
| 5,101,266 | 3/1992 | Schlig et al. | 538/75 |
| 5,609,978 | 3/1997 | Giorgianni et al. | 430/30 |

FOREIGN PATENT DOCUMENTS

| | | |
|---|---|---|
| 0 268 704 | 6/1988 | (EP) . |
| 0 385 496 | 9/1990 | (EP) . |
| 0 605 898 | 7/1994 | (EP) . |
| 0 779 542 | 6/1997 | (EP) . |
| 6-204444 | 7/1994 | (JP) . |
| WO 89/12941 | 12/1989 | (WO) . |

*Primary Examiner*—Hoa Van Le
(74) *Attorney, Agent, or Firm*—Frishauf, Holtz, Goodman, Langer & Chick, P.C.

(57) ABSTRACT

An image forming method is disclosed, comprising:

exposing a photosensitive functional element having a red-sensitive function, a green-sensitive function, a blue-sensitive function and an invisible light-sensitive function to obtain an R image information, a G image information, a B image information and an invisible image information, mixing said invisible image information and an RGB visible image information comprised of the R image information, the G image information and the image information to form a mixed image information, and outputting the mixed image information.

26 Claims, No Drawings

IMAGE FORMING METHOD

FIELD OF THE INVENTION

The present invention relates to a method for forming a visible image, and in particular to a visible image forming method by use a invisible image information to thereby outputting image excellent in color reproduction and representation, in which green woods, distant mountain ranges or beautiful flowers are reproduced as vividly as viewed by by the photographer.

BACKGROUND OF THE INVENTION

Since Kodachrome was put on sale by Eastman Kodak Co. in 1935, various improvements in color photography have been continueing and enhancement of its photographic performance is still in advance, including fine image structure, enhancement of graininess and, and enhanced color reproducibility. Of these, with regard to a technique for enhancing color reproduction, there was some marked enhancement of color reproduction so far. One of them concerns a colored coupler having an automasking function (as described in U.S. Pat. No. 2,455,170).

The colored coupler is mainly used for enhancing color reproduction of a color negative film. The colored coupler contributes to correct unwanted absorption of yellow, magenta and cyan dyes used in the color negative film. Thus the colored coupler compensates for imagewise color contamination due to unwanted absorption of the dye, leading to greatly enhanced color reproduction.

Clearer color reproduction is also desired and as a technique for enhancing color purity of the color negative film, there was proposed a development effect, so-called interlayer effect described in Belgian Patent 710,344 and German Patent 2,043,934.

Furthermore, to promote the interlayer effect, a DIR coupler was developed, as described in U.S. Pat. No. 3,277,554, leading to marked enhancement in color purity reproduction.

Thus enhanced chromatic color reproduction is aimed, while there was proposed techniques to faithfully reproduce color as seen by the human eye. One of them concerns control of spectral sensitivity distribution of a blue-sensitive layer, a green-sensitive layer and a red-sensitive layer of a color film, as described in JP-A 5-150411 (hereinafter, the term, JP-A means a unexamined, published Japanese Patent Application).

There were further proposed techniques of enhancing color reproduction, in which differences in spectral sensitivity distribution between cones of the human eye and the color film was noted. The color film generally has a spectral sensitivity distribution such that a blue-sensitive layer has a sensitivity maximum at longer wavelengths, a green-sensitive layer has a sensitivity maxim at slightly longer wavelengths and a red-sensitive layer has a sensitivity maximum at rather longer wavelengths, as compared to the spectral sensitivity distribution of the human eye. Further, red cones of the eye have a region in the vicinity of 500 nm, having negative sensitivity. To allow the spectral sensitivity of the color film to meet the spectral sensitivity of the eye, the spectral sensitivity distribution by use of sensitizing dyes and the interlayer effect by use of a so-called donor layer were controlled, enabling faithful reproduction, to a certain extent, of intermediate colors, which had been hard to reproduce, as described in JP-A 61-34541.

Employing these techniques, color reproducibility of the color film enabled hue of objects to be faithfully reproduced.

As mentioned above, color reproducibility of color photography has steadily been advanced. However, it is still true that with regard to the color photographic materials of the next generation, further enhancement of color reproducibility having different aspects is still desired. The reason for this is that amateur photographers are often still disappointed when they receive their prints. Cited as disappointments are often, when photographing fresh green woods, red flowers and distant mountain ranges. There are numerous photographers, when they have taken such pictures and receive the processed prints, the resulting prints are different from their expectation or from what they had in mind, in which the fresh green color of woods shows dark and dull tones, the fine details of petals of the red flowers is lost, leading to so-called red saturation, and the distant mountain ranges appear to be veiled in mist, losing the three dimensional realism in which they were originally viewed.

Thus color photography is not satisfactory simply with faithfulness and clearness in color reproduction but it also requires excellent image rendering, which vividly reproduce the scene being photographed.

On the other hand, along with recent progress of information processing technology, development of a technique is being advanced, in which images of a color negative film or a color reversal film can be read with a color scanner to be converted to digital image signals, which are further subjected to an appropriate image processing, and thereafter, output signals are produced in response to these image information and recorded on an outputting material such as color print paper.

In fact, the use of the technique of temporarily converting to digital images make it easy to make correction so as to form the images expected by the user. However, a limitation still remains in that it is impossible to exceed the amount of information recorded on the color film.

Herein, there still remain problems to be solved with regard to how to record subject information at the time of photographing as many as possible on the color film and apply them in the process of digital image processing to satisfy requirement of clearly reproduce the scene at the time of user's photographing. In this regard, the method thereof has not yet been established.

SUMMARY OF THE INVENTION

It is an object of the present invention to provide a visible image outputting method to output images with excellent image quality in such a manner that green woods and red flowers are vividly reproduced, and the distant range of mountains and blue sky are clearly reproduced; and a visible image forming method by use thereof.

The above object of the present invention can be accomplished by the following constitution:

1. An image forming method comprising:
   exposing a photosensitive functional element having a red-sensitive function, a green-sensitive function, a blue-sensitive function and an invisible light-sensitive function to obtain an R image information, a G image information, a B image information and an invisible image information,
   mixing said invisible image information and an RGB visible image information comprised of the R image information, the G image information and the image information to form a mixed image information, and
   outputting the mixed image information;
2. The image forming method described above, wherein said photosensitive element is a silver halide light sensitive color photographic material (1) comprising a support having thereon photographic component layers including a red-sensitive layer, a green-sensitive layer, a blue-sensitive layer and an invisible light-sensitive layer;

3. The image forming method described in 2, wherein the outputted image information is a visible image information;

4. The image forming method described in 2, wherein said invisible light-sensitive layer contains a coupler capable of forming an invisible image dye upon reaction with an oxidation product of a color developing agent;

5. The image forming method described in 4, wherein the invisible light-sensitive layer is an infrared-sensitive layer and the invisible image dye being an infrared absorption dye;

6. The image forming method described in 2, wherein the red-sensitive layer contains a cyan dye forming coupler;

7. The image forming method described in 2, wherein the green-sensitive layer contains a magenta dye forming coupler;

8. The image forming method described in 2, wherein the blue-sensitive layer contains a yellow dye forming coupler;

9. The image forming method described in 2, wherein the RGB visible image information or said invisible image information is formed with a dye image and a silver image;

10. The image forming method described in 2, wherein the silver halide color photographic material comprises including a red-sensitive layer containing a cyan dye forming coupler, a green-sensitive layer containing a magenta dye forming coupler, a blue-sensitive layer containing a yellow dye forming coupler and an invisible light-sensitive layer which is an infrared-sensitive layer containing an infrared absorption dye forming coupler; the RGB visible image information or the invisible image information being formed with a dye image and a silver image;

11. The image forming method described in 2, wherein the exposed photographic material is further subjected to processing to obtain the R image information, G image information, B image information and invisible image information;

12. The image forming method described in 1, wherein the mixing is electrically performed;

13. The image forming method described in 1, wherein the mixed image information is outputted onto a silver halide light sensitive color photographic material (2).

14. The image forming method described in 2, wherein the mixed image information is outputted onto a silver halide light sensitive color photographic material (2);

15. The image forming method described in 1, wherein the mixed image information is outputted by an electric image outputting means;

16. The image forming method described in 15, wherein the mixed image information is outputted by allowing a colorant to be transferred onto a support;

17. The image forming method described in 2, wherein the mixed image information is outputted by an electric image outputting means;

18. The image forming method described in 17, wherein the mixed image information is outputted by allowing a colorant to be transferred onto a support;

19. The image forming method described in 13, wherein the mixed image information is outputted by means of scanning exposure onto a silver halide light sensitive color photographic material (2);

20. The image forming method described in 14, wherein the mixed image information is outputted by means of scanning exposure onto a silver halide light sensitive color photographic material (2);

21. The image forming method described in 19, wherein the silver halide color photographic material (2) contains a coupler capable of forming an invisible image dye upon reaction with an oxidation product of a color developing agent;

22. The image forming method described in 19, wherein the silver halide color photographic material (2) has an invisible light-sensitive layer;

23. The image forming method described in 22, wherein the silver halide color photographic material (2) has an infrared-sensitive layer;

24. The image forming method described in 23, wherein the silver halide color photographic material (2) contains a coupler capable of forming an infrared absorption dye upon reaction with an oxidation product of a color developing agent;

25. The image forming method described in 2, wherein the R-image information, the G-image information, the-image information and said invisible image information each are obtained by an electrically reading means;

26. The image forming method described in 1, wherein said photosensitive element is an image pick-up device having a charge coupled device;

27. A silver halide light sensitive color photographic material comprising a support having thereon photographic component layers including a visible light-sensitive layer, at least one of the component layers containing a coupler capable of forming an invisible image dye upon reaction with an oxidation product of a color developing agent;

28. The color photographic material described in 27, wherein the component layers comprise a red-sensitive layer, a green-sensitive layer, a blue-sensitive layer and an invisible light-sensitive layer;

29. The color photographic material described in 28, wherein the support is a reflection support.

DETAILED DESCRIPTION OF THE INVENTION

The silver halide light sensitive color photographic camera material will be described below.

Invisible Light-sensitive Silver Halide Emulsion Layer:

The invisible light-sensitive silver halide emulsion layer according to the invention, i.e., the silver halide emulsion layer which is sensitive to invisible light (hereinafter, also denoted as a invisible light-sensitive layer) refers to a layer sensitive to ultraviolet radiation and having a sensitivity maximum at a wavelength of 400 nm or less, or a layer sensitive to infrared radiation and ving a sensitivity maximum at a wavelength of 680 nm or more. Thus, a layer sensitive to ultraviolet radiation (hereinafter, denoted as a ultraviolet sensitive layer) is a layer having a sensitivity maximum preferably at wavelengths of 280 to 400 nm, and more preferably 320 to 400 nm. A layer sensitive to infrared radiation (hereinafter, denoted as an infrared sensitive layer) is a layer having a sensitivity maximum preferably at wavelengths of 680 to 950 nm, and more preferably 680 to 850 nm.

Layer Arrangement

With regard to the arrangement of the invisible light sensitive layer, the ultraviolet sensitive layer is provided preferably between a blue-sensitive emulsion later and a protective layer; and the infrared sensitive layer is provided preferably between an yellow filter layer and a support.

Spectral-sensitizing Means

Spectral sensitivity of the invisible light-sensitive layer can be achieved by adjusting the halide composition of a silver halide emulsion, with respect to the ultraviolet sensitive layer. A silver halide emulsion suitable for the ultraviolet sensitive layer is a silver bromochloride or silver iodobromochloride emulsion preferably having a silver chloride content of 30 mol % or more, and more preferably 60 mol % or more. The infrared sensitive layer can be achieved by use of a sensitizing dye. Preferred sensitizing dyes usable in the infrared sensitive layer include those represented by the following formula [I-a] or [I-b]:

Formula [I-a]

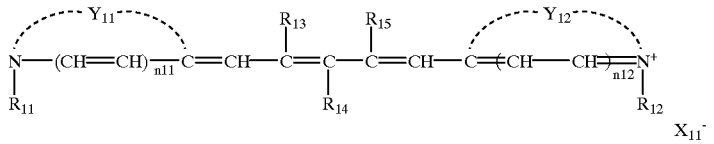

Formula [I-b]

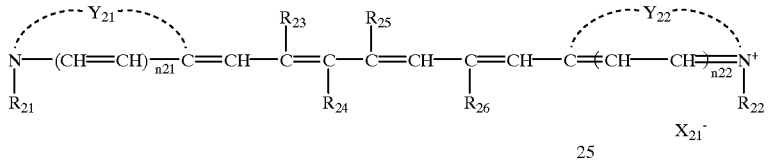

wherein $Y_{11}$, $Y_{12}$, $Y_{21}$ and $Y_{22}$ each represent a non-metallic atom group necessary for forming a 5- or 6-membered nitrogen-containing heterocyclic ring, including, e.g., a benzothiazole ring, a naphthothiazole ring, a benzoselenazole ring, a naphthoselenazole ring, a benzooxazole ring, a naphthooxazole ring, a quinoline ring, a 3,3-dialkylindolenine ring, a benzimidazole ring and a pyridine ring. These heterocyclic rings may be substituted by a lower alkyl group, a lower alkoxy group, a hydroxy group, an aryl group, an alkoxycarbonyl group or a halogen atom. $R_{11}$, $R_{12}$, $R_{21}$ and $R_{22}$ each represent a substituted or unsubstituted alkyl, aryl, or aralkyl group. $R_{13}$, $R_{14}$, $R_{23}$, $R_{24}$, $R_{25}$ and $R_{26}$ each represent a hydrogen atom, an alkyl group, an alkoxy group, a phenyl group, a benzyl group, ech of which may be substituted, or $—NW_1(W_2)$, in which W1 and W2 each represent a substituted or unsubstituted alkyl group (having 1 to 18 carbon atoms and preferably 1 to 4 carbon atoms) or aryl group, provided that $W_1$ and $W_2$ may be linked with eact other to form a 5- or 6-membered nitrogen-containing heterocyclic ring. $R_{13}$ and $R_{15}$, or $R_{23}$ and $R_{25}$ may be linked with each other to form a 5- or 6-membered nitrogen-containing heterocyclic ring. $X_{11}^-$ and $X_{21}^-$ each represent an anion; $n_{11}$, $n_{12}$, $n_{21}$ and $n_{22}$ are each 0 or 1.

Examples of the compound represented by formula [I-a] or [I-b] include Compounds A-1 through A-14 and No.13 described in JP-A 7-13289. These sensitizing dyes may be used singly or in combination. Specifically, combination of the sensitizing dyes is often employed for the purpose of supersensitization. Along with the sensitizing dye may be contained a dye having no spectral sensitizing capability or a substance which does not substantially absorb visible light. Usable sensitizing dyes, combination of dyes exhibiting supersensitization and super-sensitizing substances are described in Research Disclosure vol.176, 17643 (1978, December) page 23, sect.IV-J; JP-B 49-25500 and 43-4938 (herein, the term, JP-B means an examined, published Japanese Patent); JP-A 59-19032, 59-192242, 3-15049 and 62-123454. The sensitizing dye described above is contained in an amount of $1\times10^{-7}$ to $1\times10^{-2}$, and preferably $1\times10^{-6}$ to $5\times10^{-3}$ mol per mol of silver halide.

Exemplary examples of the dye represented by formula [I-a] or [I-b] are shown below, but the dye is not limited to these examples.

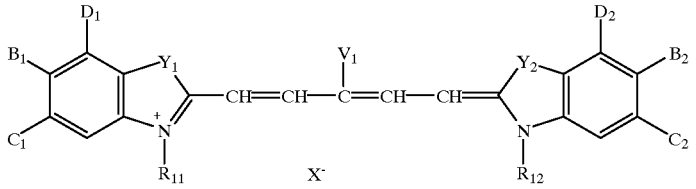

| Compd. No. | $Y_1$ | $Y_2$ | $B_1$ | $C_1$ | $B_2$ | $C_2$ | $R_{11}$ | $R_{12}$ | $V_1$ | $X^-$ | $D_1$ | $D_2$ |
|---|---|---|---|---|---|---|---|---|---|---|---|---|
| 1-1 | Se | Se | H | H | H | H | $C_2H_5$ | $C_2H_5$ | H | I | H | H |
| 1-2 | S | S | H | H | H | H | $C_2H_5$ | $C_2H_5$ | H | I | H | H |
| 1-3 | Se | Se | H | H | H | H | $(CH_2)_2OCH_3$ | $(CH_2)_2OCH_3$ | H | Br | H | H |
| 1-4 | Se | S | H | H | H | H | $(CH_2)_3SO_3H$ | $C_2H_5$ | H | — | H | H |
| 1-5 | S | S | H | $OCH_3$ | H | H | $C_2H_5$ | $C_2H_4OH$ | $C_2H_5$ | Br | H | H |
| 1-6 | S | S | $C_2H_5$ | H | $C_2H_5$ | H | $C_5H_{11}$ | $C_5H_{11}$ | $C_2H_5$ | Br | H | H |
| 1-7 | S | S | $C_2H_5$ | H | $C_2H_5$ | H | $C_5H_{11}$ | $C_5H_{11}$ | $C_4H_9$ | Br | H | H |
| 1-8 | S | S | $OCH_3$ | $OCH_3$ | $OCH_3$ | $OCH_3$ | $C_2H_5$ | $C_2H_5$ | $CH_3$ | I | H | H |
| 1-9 | S | S | $OCH_3$ | H | $OCH_3$ | H | $C_2H_5$ | $C_2H_5$ | H | I | $OCH_3$ | $OCH_3$ |
| 1-10 | S | S | $OCH_3$ | H | $OCH_3$ | H | $CH_2CH=CH_2$ | $CH_2CH=CH_2$ | H | I | $OCH_3$ | $OCH_3$ |
| 1-11 | S | S | $OCH_3$ | H | $OCH_3$ | H | $CH_2CH=CH_2$ | $CH_2CH=CH_2$ | $C_2H_5$ | Br | $OCH_3$ | $OCH_3$ |

1-12

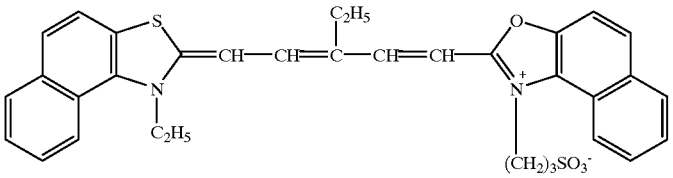

1-13

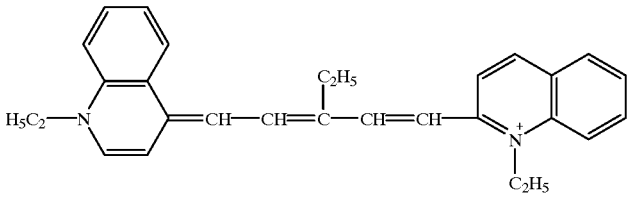

1-14

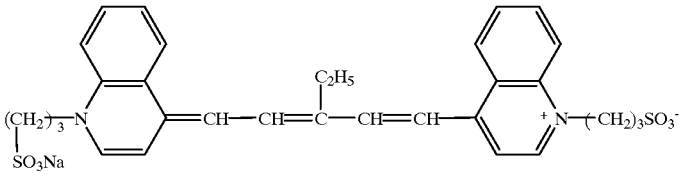

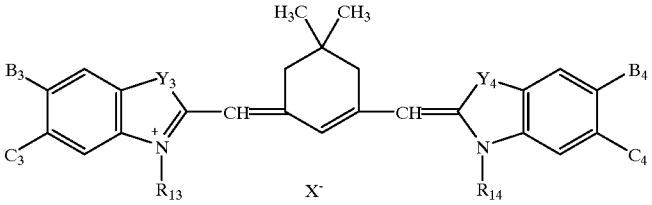

| Compd. No. | $Y_3$ | $Y_4$ | $B_3$ | $C_3$ | $B_4$ | $C_4$ | $R_{13}$ | $R_{14}$ | $X^-$ |
|---|---|---|---|---|---|---|---|---|---|
| 2-1 | S | S | H | H | H | H | $C_2H_5$ | $C_2H_5$ | Br |
| 2-2 | S | S | $CH_3$ | Cl | H | Cl | $C_2H_5$ | $C_2H_5$ | Br |
| 2-3 | S | S | $CH_3$ | H | $CH_3$ | H | $C_2H_5$ | $C_2H_5$ | I |
| 2-4 | S | S | H | Cl | H | Cl | $C_2H_5$ | $C_2H_5$ | Br |
| 2-5 | S | S | H | H | H | H | $C_2H_5$ | $C_4H_9$ | I |
| 2-6 | S | S | H | H | H | H | $C_2H_5$ | $C_5H_{11}$ | Br |
| 2-7 | S | S | H | H | H | H | $C_2H_5$ | $C_7H_{15}$ | Br |
| 2-8 | S | S | H | H | H | H | $C_2H_5$ | $C_{10}H_{21}$ | Br |
| 2-9 | S | S | H | H | H | H | $C_3H_7$ | $C_3H_7$ | Br |
| 2-10 | S | S | H | H | H | H | $C_4H_9$ | $C_4H_9$ | PTS$^{-}$* |
| 2-11 | S | S | H | H | H | H | $C_5H_{11}$ | $C_5H_{11}$ | Br |
| 2-12 | S | S | H | H | H | H | $C_7H_{15}$ | $C_7H_{15}$ | Br |
| 2-13 | S | S | $CH_3$ | H | H | H | $C_2H_5$ | $C_5H_{11}$ | Br |
| 2-14 | S | S | $CH_3$ | H | $CH_3$ | H | $C_2H_5$ | $C_5H_{11}$ | Br |
| 2-15 | S | S | $OCH_3$ | H | H | H | $C_2H_5$ | $C_2H_5$ | Br |
| 2-16 | S | S | $OCH_3$ | H | H | H | $C_2H_5$ | $C_5H_{11}$ | Br |
| 2-17 | S | S | $CH_3$ | $CH_3$ | $CH_3$ | $CH_3$ | $C_2H_5$ | $C_2H_5$ | Br |
| 2-18 | S | S | $C_3H_7$(i) | H | $C_3H_7$(i) | H | $C_2H_5$ | $C_2H_5$ | Br |
| 2-19 | S | S | H | H | H | H | $C_2H_5$ | $(CH_2)_3SO_3^-$ | — |
| 2-20 | S | S | $CH_3$ | H | $CH_3$ | H | $C_2H_5$ | $(CH_2)_5SO_3^-$ | — |
| 2-21 | S | S | $CH_3$ | H | $CH_3$ | H | $(CH_2)_3SO_3HN(C_2H_5)_3$ | $(CH_2)_3SO_3^-$ | — |
| 2-22 | S | S | H | H | H | H | $C_2H_5$ | $(CH_2)_4SO_3^-$ | — |
| 2-23 | S | S | H | $CH_3$ | H | $CH_3$ | $C_2H_5$ | $C_5H_{11}$ | Br |
| 2-24 | Se | Se | H | H | H | H | $C_2H_5$ | $C_2H_5$ | Br |
| 2-25 | Se | Se | $CH_3$ | H | $CH_3$ | H | $C_2H_5$ | $C_2H_5$ | Br |

*PTS: p-toluenesulfonic acid 2-26
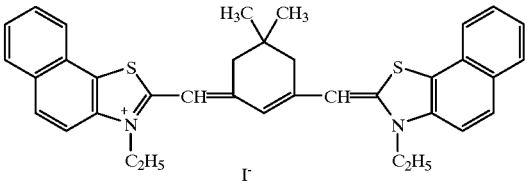
2-27
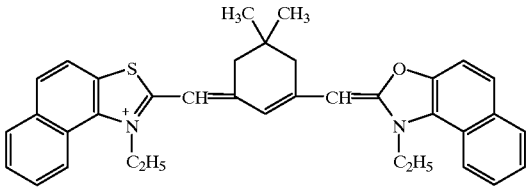
3-1
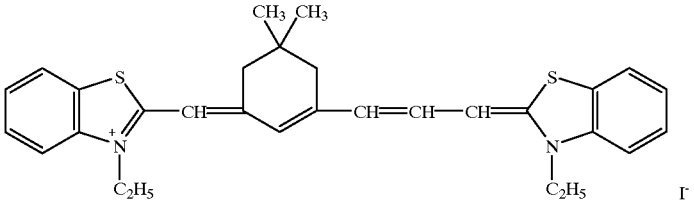
3-2
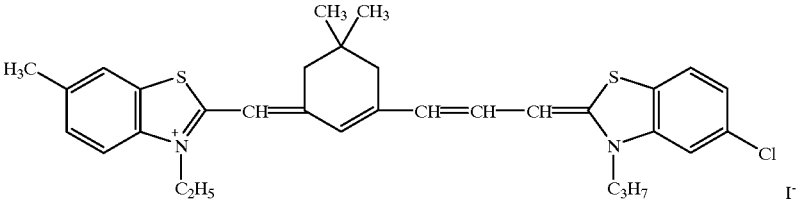
3-3
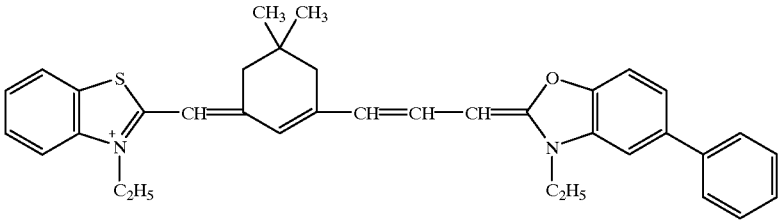
3-4
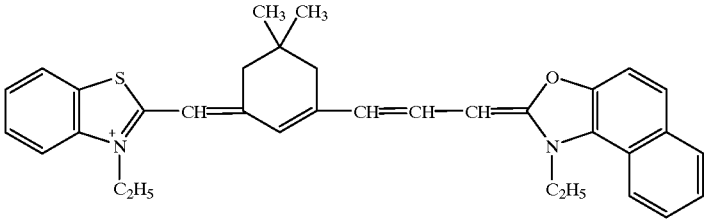

-continued
3-5
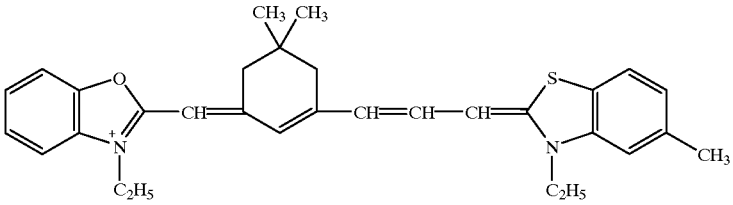
$I^-$
3-6
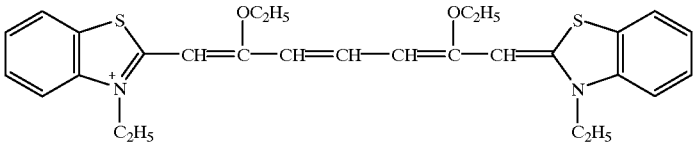
$I^-$
3-7
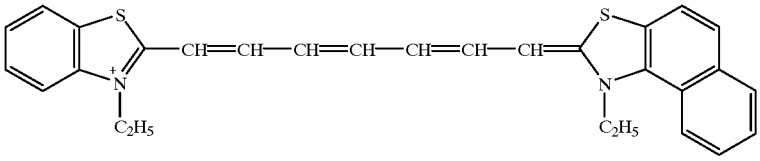
$I^-$
3-8
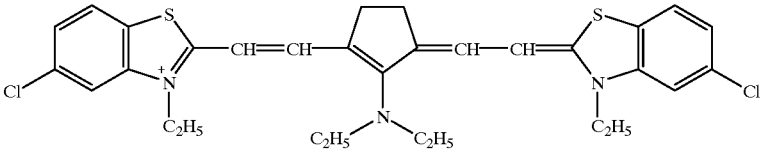
$ClCO_4^-$
3-9
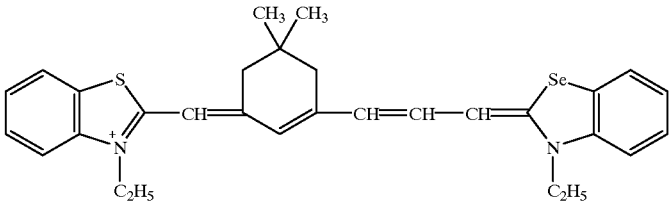
$I^-$
3-10
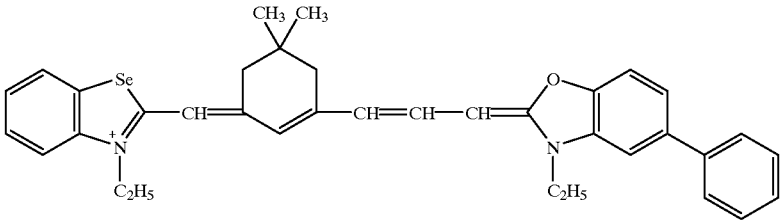
$I^-$ -continued
3-11
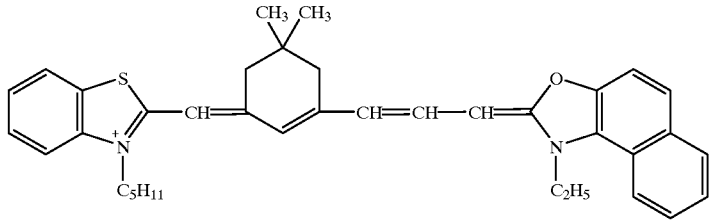
I⁻
3-12
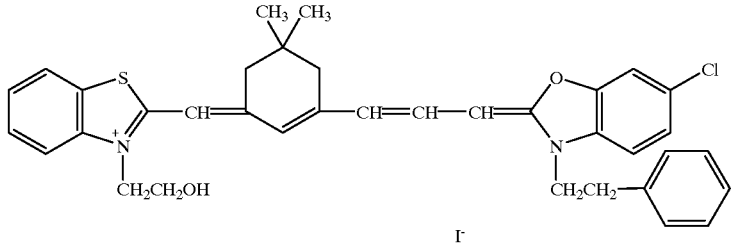
I⁻
3-13
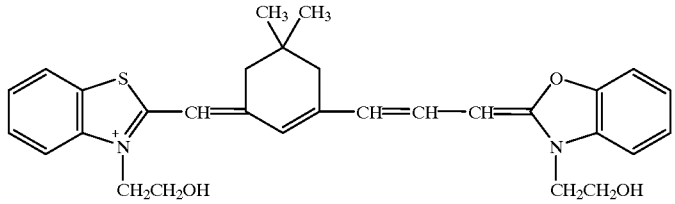
I⁻
3-14
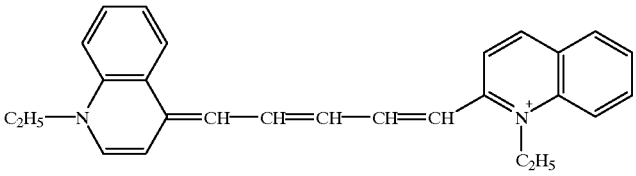
I⁻
3-15
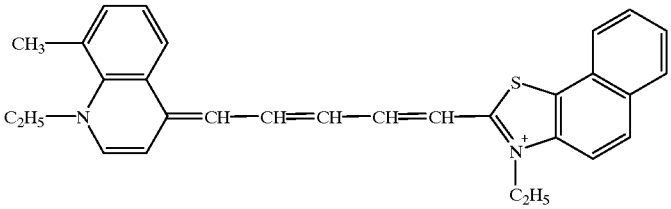
I⁻
3-16
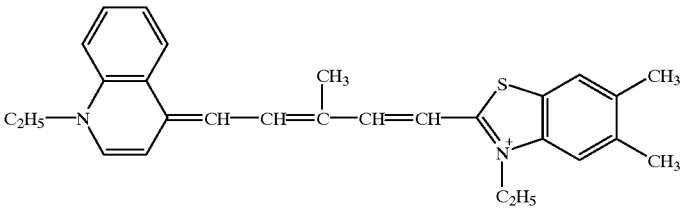
I⁻

-continued 3-17

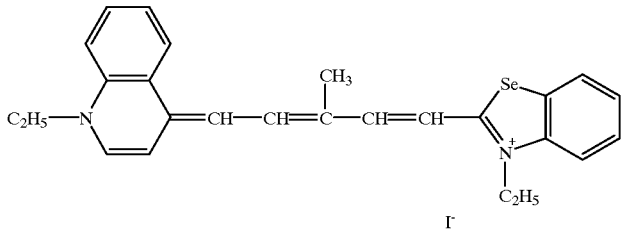

3-18

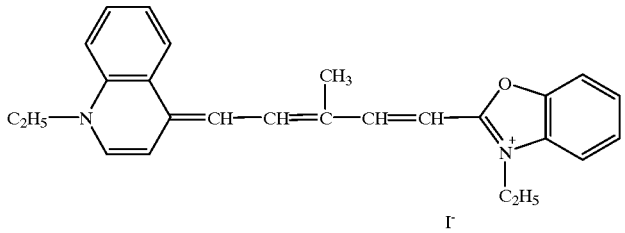

3-19

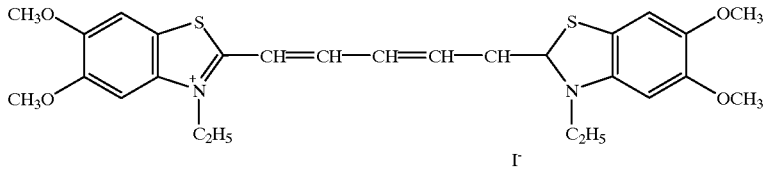

3-20

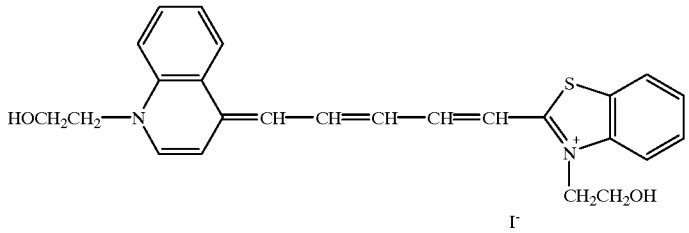

3-21

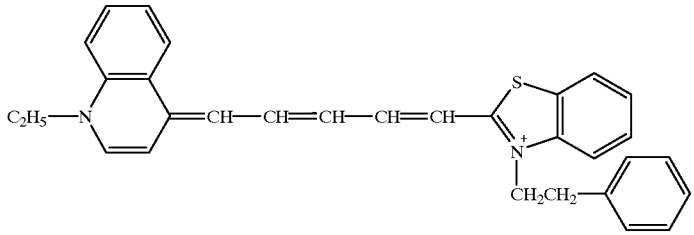

The dyes described above can be readily synthesized, for example, according to the method described in F. M. Hammer, The Chemistry of Heterocyclic Compounds vol. 18, "The Cyanine Dyes and Related Compounds (A. Weissberger ed., Interscience, New York, 1964).

Coupler

The photographic material related to the present invention comprises a red-sensitive silver halide emulsion layer, a green-sensitive silver halide emulsion layer, a blue-sensitive silver halide emulsion layer, and a invisible light-sensitive silver halide emulsion layer; and these spectrally sensitive layers each preferably contain a coupler capable of forming a dye different in color upon coupling with an oxidation product of a color developing agent. Exemplarily, a cyan coupler is contained in the red-sensitive silver halide emulsion layer, a magent coupler is contained in the green-sensitive silver halide emulsion layer, a yellow coupler is contained in the blue-sensitive silver halide emulsion layer and a infrared dye forming coupler is contained in the invisible light-sensitive silver halide emulsion layer; but a combination of the sensitive layer and a coupler is not specifically limited.

The coupler capable of forming an infrared-absorbing dye upon reaction with an oxidation product of a color developing agent is preferably one represented by the following formula [II] or [III]:

Formula [II]

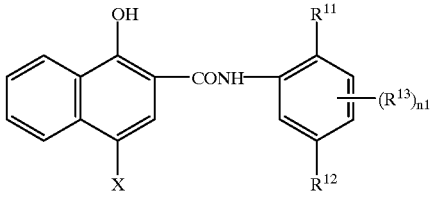

wherein $R^{11}$ represents an alkyl group, an alkoxy group, a phenoxy group or a halogen atom; $R^{12}$ represents an alkyl group, a phenyl group, an alkoxy group, an alkoxycarbonyl group, an aryloxycarbonyl group, a carbamoyl group or a sulfamoyl group; $R^{13}$ represents a hydrogen atom or a substituent; $n_1$ is an integer of 1, 2 or 3; and X represents a hydrogen atom or a group capable of being released upon reaction with an oxidation product of a color developing agent;

Formula [III]

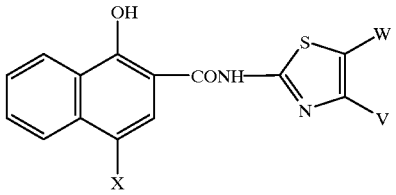

wherein V represents an aryl group; W represents an alkyl group; and X represents a hydrogen atom or a group capable of being released upon reaction with an oxidation product of a color developing agent. Examples of the alkyl group represented by $R_{11}$, $R_{12}$ or W include methyl, ethyl, propyl, isopropyl, n-butyl, tert-butyl, n-pentyl, cyclopentyl, n-hexyl, cyclohexyl, n-octyl and n-dodecyl. The alkyl group may be substituted by a substituent. Examples of the substituent include a halogen atom (e.g., chlorine atom, bromine atom, fluorine atom), an alkoxy group (e.g., methoxy, ethoxy, 1,1-dimethylethoxy, n-hexyoxy, n-dodecyloxy), an aryloxy group (e.g., phenoxy, naphthyloxy), an alkoxycarbonyl group (e.g., methoxycarbonyl, ethoxycarbonyl, n-butoxycarbonyl, 2-ethylhexylcarbonyl), an aryloxycarbonyl (e.g., phenoxycarbonyl, naphthyloxycarbonyl), an alkenyl group (e.g., vinyl, allyl), a heterocyclic group (e.g.,2-pyridyl, 3-pyridyl, 4-pyridyl, morphoryl, piperidyl, piperazyl, pyromidyl, pyrazolyl, furyl), an alkynyl group (e.g., propargyl), an amino group (e.g., amino, N,N-dimethylamino, anilino), a hydroxy group, a cyano group, a sulfo group, a carboxyl group, a sulfonamido group (e.g., methylsulfonylamino, ethylsulfonylamino, n-butylsulfonylamino, n-octylsulfonylamino, phenylsulfonylamino).

Examples of the alkoxy group represented by $R^{11}$ and $R^{12}$ include methoxy, ethoxy, butoxy, octyloxy, dodecyloxy, isopropyloxyt-butyloxy, 2-ethylhexyloxy. These groups may be substituted by an alkyl group or a substituent of the alkyl group, as defined in $R^{11}$ and $R^{12}$.

Examples of the aryloxy group represented by $R^{11}$ include phenyloxy and naphthyloxy. These groups may be substituted by a substituent as defined in $R^{13}$ described below. Examples of the halogen atom represented by R11 include a chlorine atom, bromine atom and iodine atom.

Examples of the alkoxy carbonyl group represented by $R^{12}$ include methoxycarbonyl, ethoxycarbonyl, isopropyloxycarbonyl, t-butyloxycarbonyl, 2-ethylhexyloxycarbonyl and dodecyloxycarbonyl. These group may be substituted by an alkyl group or its substituent, as defined in $R^{11}$ and $R^{12}$. Examples of the aryloxycarbonyl group include phenyloxycarbonyl and naphthyloxycarbonyl. These group may be substituted by a substituent, as defined in $R^{13}$ described below. Examples of the carbamoyl group represented by $R^{12}$ include methylcarbamoyl, propylcarbamoyl, t-butylcarbamoyl, 2-ethylhexylcarbamoyl, pentadecycarbamoyl, dibutylaminocarbonyl, and N-methyl-N-(2-ethylhexyl) aminocarbonyl. These groups may be substituted by an alkyl group or its substituent, as defined in $R^{11}$ and $R^{12}$. Examples of the sulfamoyl group represented by $R^{12}$ include methylsulfamoyl, propylsulfamoyl, t-butylsulfamoyl, 2-ethylhexylsulfamoyl, pentadecylsulfamoyl, dibutylaminosulfonyl, and N-methyl-N-(2-ethylhexy) aminosulfonyl.

Examples of the aryl group represented by V or $R^{12}$ include phenyl and naphthyl. These group may be substituted by a substituent, as defined in $R^{13}$ described below.

The substituent represented by $R^{13}$ may be any one capable of being substituted on a benzene ring. Examples thereof include an alkyl group (e.g., methyl, ethyl, n-propyl, isopropyl, tert-butyl, n-pentyl, cyclopentyl, n-hexyl, cyclohexyl, n-octyl, n-dodecyl), an alkenyl group (e.g., vinyl, allyl9, an alkynyl group (e.g.,propargyl), an aryl group (e.g., phenyl, naphthyl), a heterocyclic group (e.g., pyridyl, thiazolyl, oxazolyl, imidazolyl, furyl, pyrrolyl, pirazinyl, pyrimidinyl, pyridadinyl, selenazolyl, sulforanyl, piperidinyl, pyrazolyl, tetrazolyl), a halogen atom (e.g., chlorine atom, bromine atom, iodine atom, fluorine atom), an alkoxy group (e.g., methoxy, ethoxy, propyloxy, n-pentyloxy, cyclopentyloxy, n-hexyloxy, cyclohexyloxy, n-octyloxy, n-dodecyoxy), an aryloxy group (e.g.,phenoxy, naphthyloxy), an alkoxycarbonyl (e.g., methyloxycarbonyl, ethyloxycarbonyl, n-butyloxycarbonyl, n-octyloxycarbonyl, n-dodecyoxycarbonyl), an aryloxycarbonyl group (e.g., phenyloxycarbonyl, naphthyloxycarbonyl), a sulfonamido group (e.g., methylsulfonylamino, ethylsulfonylamino, n-butylsulfonylamino, n-hexylsulfonylamino, cyclohexylsulfonylamino, n-octylsulfonylamino, n-dodecysulfonylamino, phenylsulfonylamino), a sulfamoyl group (e.g., aminosulfonyl, methylaminosulfonyl, dimethylaminosulfonyl, n-butylaminosulfonyl, n-hexylaminosulfonyl, cyclohexylaminosulfonyl, n-octylaminosulfonyl, n-dodecylaminosulfonyl, phenylaminosulfonyl, naphthylaminosulfonyl, 2-pyridylaminosulfonyl), an ureido group (e.g., methylureido, ethylureido, pentylureido, cyclohexylureido, n-octylureido, n-dodecylureido, phenylureido, nphthylureido, 2-pyridylaminoureido), an acyl group (e.g., acetyl, ethylcarbonyl, propylcarbonyl, n-pentylcarbonyl, cyclohexylcarbonyl, n-octylcarbonyl, 2-ethyhexylcarbonyl, n-dodecylcarbonyl, phenylcarbonyl, naphthylcarbonyl, pyridylcarbonyl), a carbamoyl group (e.g., aminocarbonyl, methylaminocarbonyl, dimethylaminocarbonyl, propylaminocarbonyl, n-pentylaminocarbonyl, cyclohexylaminocarbonyl, n-octylaminocarbonyl, 2-ethylhexylaminocarbonyl, n-dodecylaminocarbonyl phenylaminocarbonyl, naphthylaminocarbonyl, 2-pyridylaminocarbonyl), an amido group (e.g.,acetoamido, ethylcarbonylamino, propylaminocarbonyl, n-pentylcarbonylamino, cyclohexylcarbonylamino, 2-ethylhexylaminocarbonyl, n-octylcarbonylamino, dodecylcarbonylamino, benzoylamino, naphthylcarbonylamino), a sulfonyl group (e.g., methylsulfonyl, ethylsulfonyl, n-butylsulfonyl, cyclohexylsulfonyl, 2-ethylhexylsulfonyl, dodecysulfonyl, phenylsulfonyl, naphthylsulfonyl, 2-pyridylsulfonyl), an amino group (e.g., amino, ethylamino, dimethylamino, n-butylamino, cyclopentylamino, 2-ethylhexylamino, n-dodecyamino, anilino, naphthylamino, 2-pyridylamino), a cyano group, a nitro group, a carboxyl group, and a hydroxy group. These groups may be substituted by an alkyl group or its substituent, as defined in $R^{12}$.

X represents a hydrogen atom or a group capable of being released upon reaction with an oxidation product of a color developing agent. Examples of the group capable of being released upon reaction with an oxidation product of a color developing agent include a univalent group, such as a halogen atom, an alkoxy group, an aryloxy group, a heterocyclic-oxy group, an acyloxy group, an alkylthio group, an arylthio group, a heterocyclic-thio group,

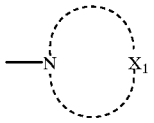

(in which X1 represents a n atomic group n ecessary for forming a 5- or 6-membered ring, along with a nitrogen atom and at leas t one selec ted from a carbon atom, an ox ygen atom, a nitrogen atom and a sulfur atom) , an acylamino group and a sulfonamido group; and a bivalent group such as an alkylene group, provided that when X is a bivalent group, a dimer is formed with the X.

Exemplary examples thereof are shown below.

Halogen atom: chlorine, bromine, fluorine Alkoxy group:

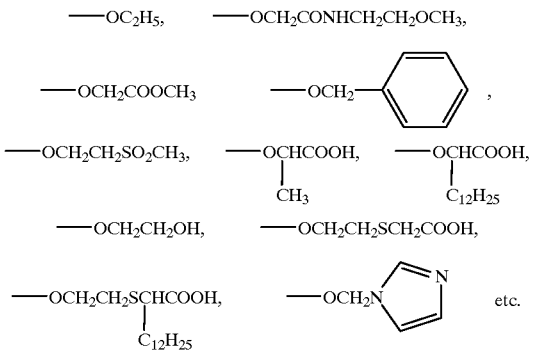

Aryloxy group:

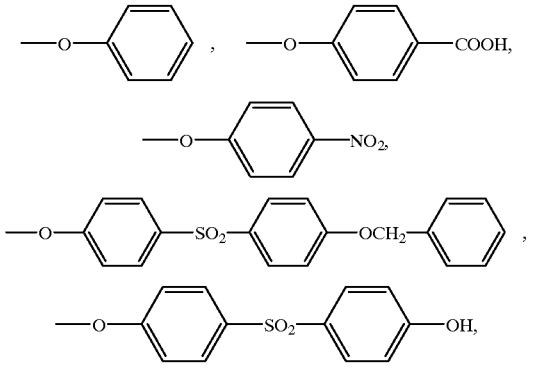

-continued

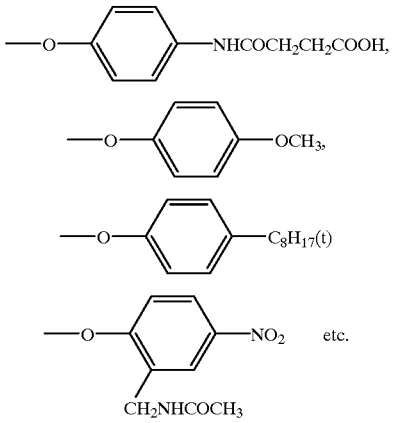

Heterocyclic-oxy group:

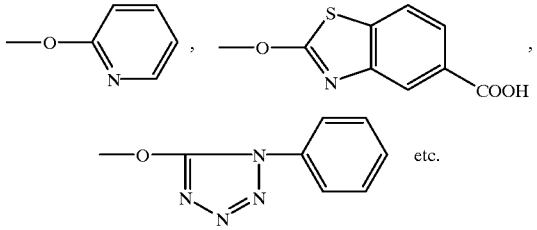

Acyloxy group:

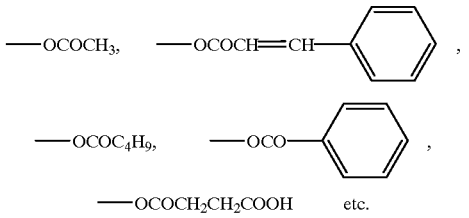

Alkylthio group:

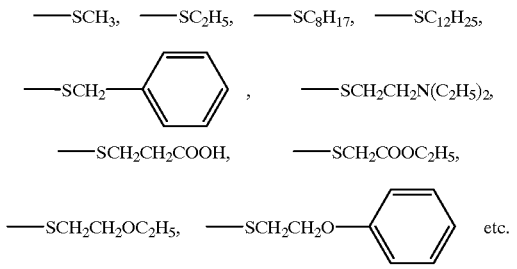

Arylthio group:

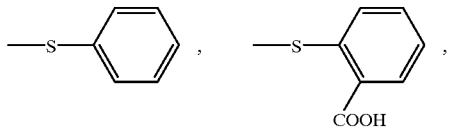

-continued
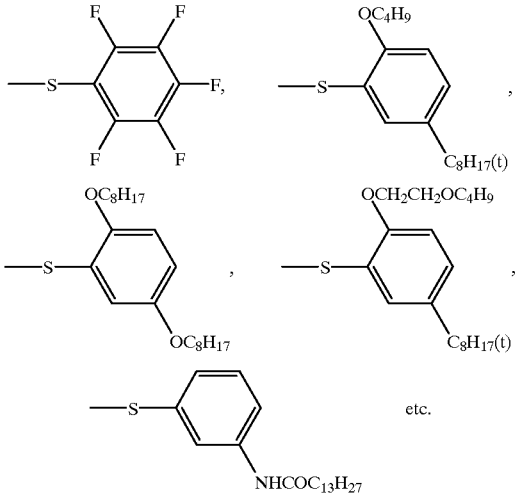
Heterocyclic-thio group
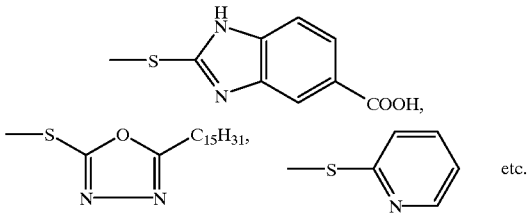
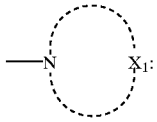
pyrazolyl, imidazolyl, triazolyl, tetrazolyl,
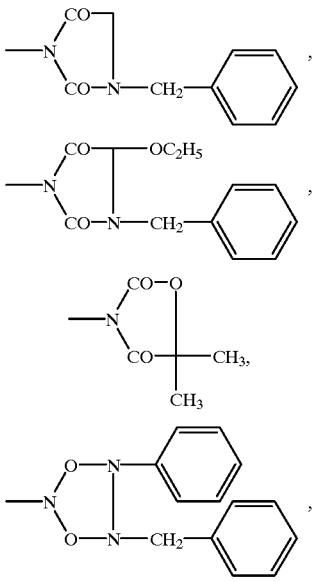
-continued
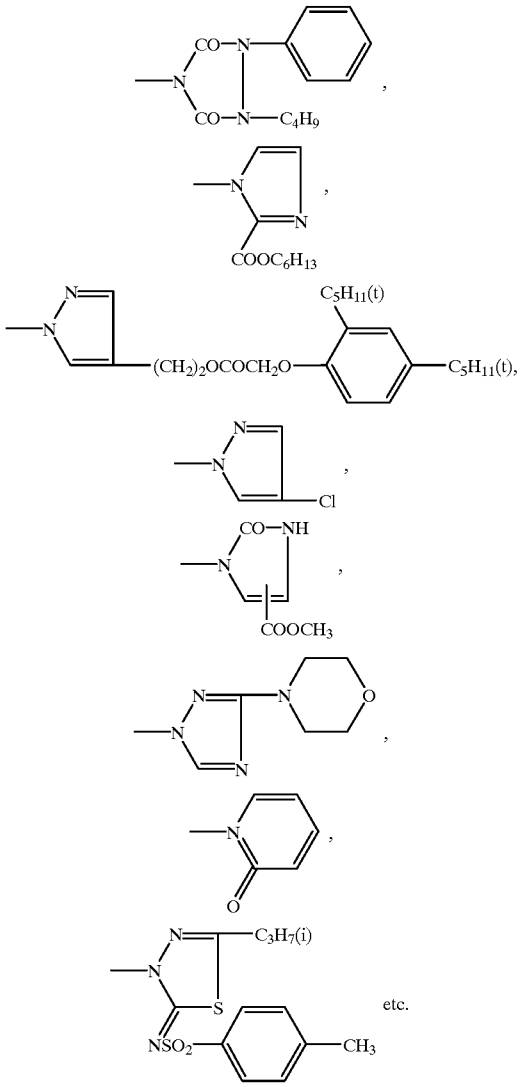
Acylamino group:
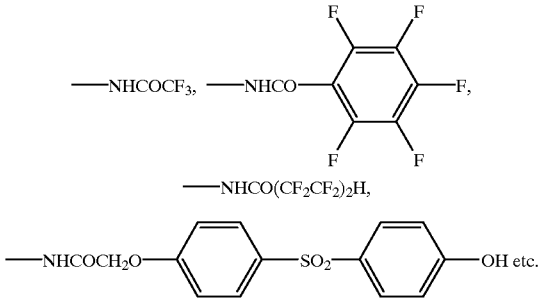
Sulfonamido group:
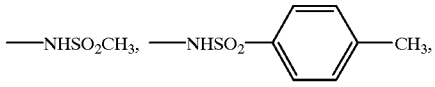

-continued

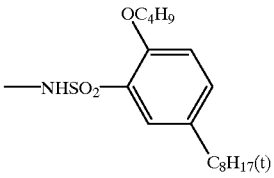

etc.

Alkylene group:

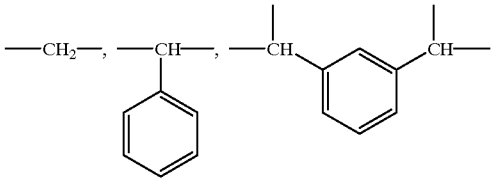

etc.

Exemplary examples of the compound represented by formula [II] or [III] are shown below, but the compound is not limited to these examples.

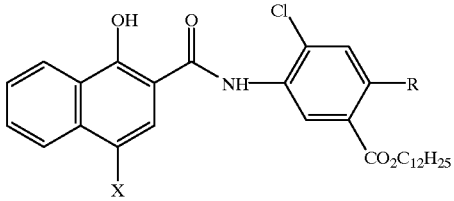

| No. | R | X |
|---|---|---|
| II-1 | H | H |
| II-2 | Br | H |
| II-3 | Br | Cl |
| II-4 | Br | —$OCH_2COOCH_3$ |
| II-5 | Br | —$OCH_2CH_2SCH_2COOH$ |
| II-6 | Br | 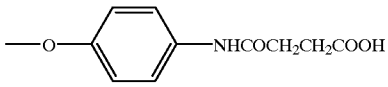 |

-continued

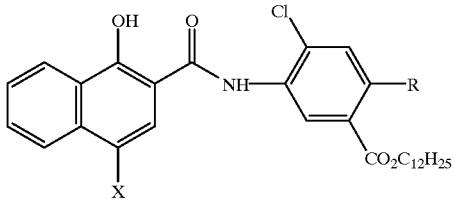

| No. | R | X |
|---|---|---|
| II-7 | Cl | H |
| II-8 | Cl | Cl |
| II-9 | Cl | 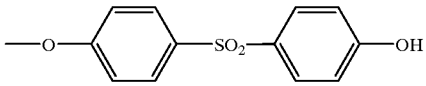 |
| II-10 | Cl | —$SCH_2CH_2OC_2H_5$ |

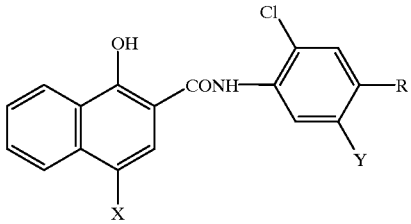

| No. | Y | R | X |
|---|---|---|---|
| II-11 | $CO_2$—$CH(CH_3)CO_2C_{12}H_{25}$ | H | Cl |
| II-12 | $CO_2$—$CH(CH_3)CO_2C_{12}H_{25}$ | Br | Br |
| II-13 | $CO_2$—$CH(CH_3)CO_2C_{12}H_{25}$ | Br | Cl |
| II-14 | $CO_2$—$CH(CH_3)CO_2C_{12}H_{25}$ | Br | Br |
| II-15 | $CO_2$—$CH(CH_3)CO_2C_{12}H_{25}$ | Br | —$OCH(CH_3)COOH$ |

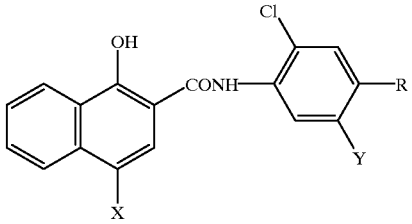
| No. | Y | R | X |
|---|---|---|---|
| II-16 | $CO_2—CH(CH_3)CO_2C_{12}H_{25}$ | Br | —O—$C_6H_4$—$NHCOCH_2CH_2COOH$ |
| II-17 | $CONHC_8H_{17}(t)$ | Br | —O—$C_6H_4$—$NHCOCH_2CH_2COOH$ |
| II-18 | $CONH(CH_2)_4O$—$C_6H_3(C_5H_{11}(t))$—$C_5H_{11}(t)$ | Br | —O—$C_6H_4$—$NHCOCH_2CH_2COOH$ |
| II-19 | $SO_2NHC_{16}H_{33}$ | Br | —O—$C_6H_4$—$NHCOCH_2CH_2COOH$ |
| II-20 | $CO_2$—$C_6H_4$—$OC_{12}H_{25}$ | Br | —O—$C_6H_4$—$NHCOCH_2CH_2COOH$ |
II-21
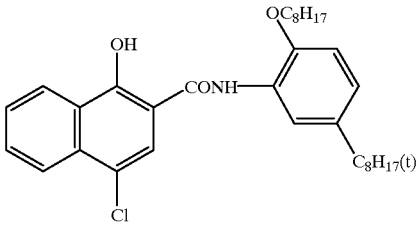
II-22
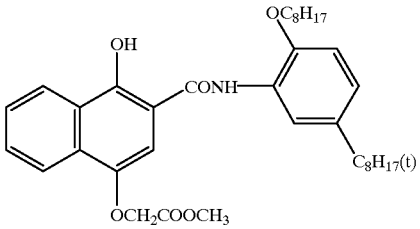
-continued
II-23
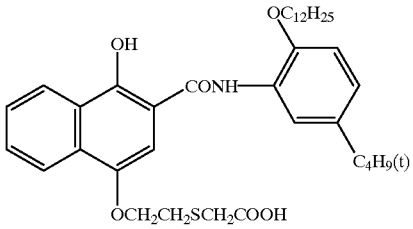
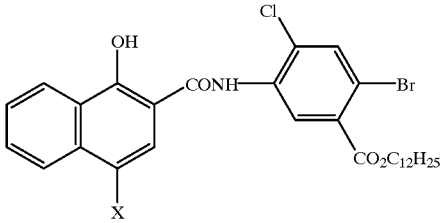
| No. | X |
|---|---|
| II-24 | —Cl |

-continued
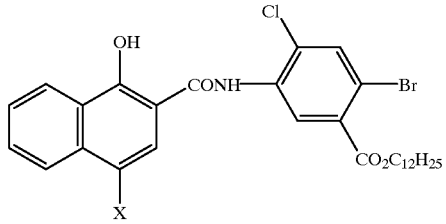
| No. | X |
|---|---|
| II-25 | —O—C$_6$H$_4$—NHCOCH$_2$CH$_2$COOH |
| II-26 | —OCH(CH$_3$)COOH |
-continued
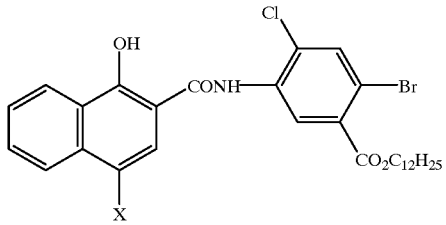
| No. | X |
|---|---|
| II-27 | —OCH($C_{12}H_{25}$)COOH |
| II-28 | —O—C$_6$H$_4$—OCH$_3$ |
| II-29 | —SCH$_2$CH$_2$COOH |
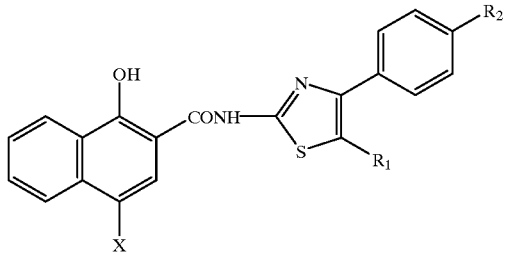
| No. | $R_1$ | $R_2$ | X |
|---|---|---|---|
| III-1 | $CH_3$ | $OCH_3$ | H |
| III-2 | $CH_3$ | $OCH_3$ | —$OCH_2COOCH_3$ |
| III-3 | $C_{14}H_{29}$ | H | —OCH($CH_3$)COOH |
| III-4 | $C_{14}H_{29}$ | $OCH_3$ | —OCH($C_{12}H_{25}$)COOH |
| III-5 | $C_{14}H_{29}$ | $OCH_3$ | —O—C$_6$H$_4$—NHCOCH$_2$CH$_2$COOH |
| III-6 | $C_{14}H_{29}$ | $OCH_3$ | —$OCH_2CH_2SCH_2COOH$ |
| III-7 | $C_{12}H_{25}$ | H | —O—C$_6$H$_4$—$OCH_3$ |

Examples of DIR compounds usable in the silver halide light sensitive color photographic camera material according to the invention include Compound D-1 through D-34 described in JP-A 4-114153. These compounds are employed preferably in the present invention. In addition to the above, examples of a diffusible DIR compound usable in the invention include those described in U.S. Pat. Nos. 4,234,678, 3,227,554, 3,647,291, 3,958,993, 4,419,886 and 3,933,500; JP-A 57-56837 and 51-13239; U.S. Pat. Nos. 2,072,363 and 2,070,266; and Research Disclosure 21228 (1981, December).

To silver halide emulsions relating to the invention are applicable techniques described in Research Disclosure No. 308119 (herein after, denoted as RD 308119), as shown below.

| Item | RD 308119 |
|---|---|
| Iodide Composition | 993, I-A |
| Preparation Method | 993, I-A, 994 E |
| Crystal Habit (Regular crystal) | 993, I-A |
| Crystal Habit (irregular crystal) | 993, I-A |
| Epitaxial | 993, I-A |
| Halide Composition (Uniform) | 993, I-B |
| Halide Composition (Non-uniform) | 993, I-B |
| Halide Conversion | 994, I-C |
| Halide Substitution | 994, I-C |
| Metal Occlusion | 994, I-D |
| Monodisperse | 995, I-F |
| Solvent Addition | 995, I-F |
| Latent Image Formation (Surface) | 995, I-G |
| Latent Image Formation (Internal) | 995, I-G |
| Photographic Material (negative) | 995, I-H |
| Photographic Material (positive) | 995, I-H |
| Emulsion Blend | 995, I-J |
| Emulsion Washing | 995, II-A |

The silver halide emulsion relating to the invention can be subjected to physical ripening, chemical ripening and spectral sensitization, according to the procedure known in the art. Additives used therein are described in RD 17643, RD 18716 and RD 308119, as shown below.

| Item | RD-308, 119 | RD-17, 643 | RD-18, 716 |
|---|---|---|---|
| Chemical Sensitizer | 996, III-A | 23 | 648 |
| Spectral Sensitizer | 996, IV-A-A, B, C, D, H, I, J | 23–24 | 648–649 |
| Super Sensitizer | 996, IV-A-E, J | 23–24 | 648–649 |
| Anti-Foggant | 998, VI | 24–25 | 649 |
| Stabilizer | 998, VI | 24–25 | 649 |

Photographic additives usable in the invention are also described in the above-described Research Disclosures, as shown below.

| Item | RD-308, 119 | RD-17, 643 | RD-18, 716 |
|---|---|---|---|
| Anti-staining Agent | 1002, VII-I | 25 | 650 |
| Dye Image-Stabilizer | 1001, VII-J | 25 | |
| Whitening Agent | 998, V | 24 | |
| U.V. Absorbent | 1003, VIII-I, XIII-C | 25–26 | |
| Light Absorbent | 1003, VIII | 25–26 | |
| light-Scattering Agent | 1003, VIII | | |
| Filter Dye | 1003, VIII | 25–26 | |

-continued

| Item | RD-308, 119 | RD-17, 643 | RD-18, 716 |
|---|---|---|---|
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant; | 1005, XI | 26–27 | 650 |
| Matting Agent | 1007, XVI | | |
| Developing Agent | 1001, XXB | | |

A variety of couplers can be employed in the invention, exemplary examples thereof are described in the Research Disclosures, as shown below.

| Item | RD 308119 | RD 17643 |
|---|---|---|
| Yellow Coupler | 1001, VII-D | 25, VII-C–G |
| Magenta Coupler | 1001, VII-D | 25, VII-C–G |
| Cyan Coupler | 1001, VII-D | 25, VII-C–G |
| Colored Coupler | 1002, VII-G | 25, VII-G |
| DIR Coupler | 1001, VII-F | 25, VII-F |
| BAR Coupler | 1002, VII-F | |
| PUG Releasing Coupler | 1001, VII-F | |
| Alkaline-soluble Coupler | 1001, VII-E | |

The additives used in the invention can be added by the dispersing method described in RD 308119 XIV. There are employed supports described in RD 17643 page 28, RD 18716 pages 647–8 and RD 308119 XIX. The photographic material relating to the invention may be provided with an auxiliary layer such as a filter layer or interlayer. as described in RD 308119 VII-K, and may have a layer arrangement, such as normal layer order, reversed layer order or unit constitution.

The silver halide light sensitive color photographic material relating to the invention can be developed by use of developing agents known in the art, as described in T. H. James, "The Theory of the Photographic Process", Fourth Edition, page 291–334; and Journal of the American Chemical Society Vol.73 [3] 100 (1951), according to the conventional method described in the above-described RD 17643 pages 28–29, RD 18716 page 615 and RD 308119 XIX.

The color photographic material can be further subjected to bleaching and fixing to remove silver from the photographic material. Form the processed color photographic material, image information can be read, for examplr using a color scanner. Alternatively, the color photographic material may be processed without bleaching or without bleaching and fixing. Thus, in one embodiment of the invention, it is possible to read image information with a color scanner from the photographic material, in which a silver image remains. In this case, none of the sensitive layers contains a coupler. For example, a red-sensitive silver halide emulsion layer, a green-sensitive silver halide emulsion layer and a blue-sensitive silver halide emulsion layer contain a cyan coupler, a magenta coupler and a yellow coupler, respectively, and an invisible light-sensitive layer contains no coupler. However, such combinations of a sensitive layer and a coupler are not specifically limited.

Subsequently, the thus obtained image information on the support described above is converted, using an apparatus such as a color scanner, to image signals corresponding to each of the red-sensitive layer image information, the green-sensitive layer image information, the blue-sensitive layer image information and the invisible light-sensitive layer image information. In one embodiment of the invention, the color scanner is composed of four sensors each having a sensitivity maximum in the region of red light, green light, blue light and infrared light (or UV light), respectively. Exemplarily, there is used a color scanner comprised of sensors each having the sensitivity maximum in the vicinity of an absorption maximum of a coupler dye (i.e., a dye formed of a coupler) used in the photographic material. In cases where the invisible light-sensitive layer containing no coupler fixes a silver image information on the support, silver image information of all of the sensitive layers is read with a sensor having a sensitivity maximum at a wavelength of 800 to 1100 nm, and from this, a silver image component of visible light calculated from the RGB image information is subtracted to extract an image information signal of the invisible light-sensitive layer.

Thus-obtained red-sensitive layer image conversion information (denoted as an R image information or simply as R), green-sensitive layer image conversion information (denoted as a G image information or simply as G) and blue-sensitive layer image conversion information (denoted as a B image information or simply as B) are mixed with invisible light-sensitive layer image conversion information (denoted as a X image information or simply as X), for example, as follows:

$$R'=R+f_R(X-R)$$

$$G'=G+f_G(X-G)$$

$$B'=B+f_B(X-B)$$

where R, G, B and X are respectively a read signal information for each pixel (or picture element) of the red-sensitive, green-sensitive, blue-sensitive or invisible light-sensitive layers before being mixed; R', G' and B' are respectively a signal information after being mixed with information X; and $f_R$, $f_G$ and $f_B$ are a mixing ratio with the X information, each being within −1 and 1 and at least one of $f_R$, $f_G$ and $f_B$ being preferably from −0.7 to 0.7. Furher, at least one of $f_R$, $f_G$ and $f_B$ preferably is not 0. Values of $f_R$, $f_G$ and $f_B$, which are related to the hue of each pixel, can be set so as to be different from each other. In cases where the invisible light-sensitive layer is a infrared-sensitive layer, for example, f-values following Formula (A) described below can be used to enhance color reproduction of green leaves or distant vistas:

Formula (A):

$$f_B=0$$

$$f_G=0.5\times A$$

$$f_R=0$$

where coefficient A follows the following relationship.

| Color Region | Condition | Coefficient A |
|---|---|---|
| I | R > G > B | G − R + 1 |
| II | G > R > B | 1 |
| III | G > B > R | 1 |
| IV | B > G > R | 1 |
| V | B > R > G | G − R + 1 |
| VI | R > B > G | G − R + 1 |

wherein, $0 \leqq R, G, B \leqq 1$.

Further, in cases where the invisible light-sensitive layer is an infrared-sensitive layer, the f-values following Formula (B) described below can be used to enhance color reproduction of flesh color or tone reproduction of red color:

Formula (B):

$$f_B=0$$

$$f_G=0$$

$$f_R=-0.4\times B$$

where coefficient B follows the relationship described below.

| Color Region | Condition | Coefficient B |
|---|---|---|
| I | R > G > B | R − G |
| II | G > R > B | 0 |
| III | G > B > R | 0 |
| IV | B > G > R | 0 |
| V | B > R > G | 0 |
| VI | R > B > G | R− B |

wherein, $0 \leqq R, G, B \leqq 1$.

The image information signal in which the invisible image information is thus mixed, is preferably further adjusted with respect to luminance range or chroma.

The present invention can also be applicable to the case when in place of the photographic material, an image pick-up device such as CCD (Charge-Coupled Device) is employed as a photographing means. In the conventional color image pick-up method, visible image information is taken out as RGB three primary color signals. In addition thereto, in the present invention, system is varied so that the invisible image information signal is also taken out. In the case of area-sequential single tip type color separation system, for example, in addition to color filters of R, G and B, a invisible light separating filter such as a infrared transmission filter is put on the pathway of an optical image of CCD to obtain RGB and invisible image signals in synchronism with the filter change. Alternatively, in the case of three-tip CCD device, an infrared cutting filter and color separation filter arrays, which are provided between the CCD and lens are modified to allow a invisible light component to be extracted.

The thus obtained image data can be output onto a color CRT or various types of color printers. Output system of the used color printer includes an ink-jet system, sublimation type thermal transfer system, thermo-autochrome system and exposure onto a silver halide color paper. Of these, the system in which a silver halide color paper is exposed through scanning, provides the most satisfactory print.

Next, a silver halide light sensitive color photographic print material relating to the present invention will be described. The invisible light-sensitive layer of the silver halide color photographic print material according to the invention is a layer having a sensitivity maximum within the range of not more than 400 nm of ultraviolet (UV) radiation, or of not less than 680 nm of infrared radiation. The UV-sensitive layer has a sensitivity maximum within the range of 320 to 400 nm, and preferably 320 to 400 nm of longer UV radiation. The infrared-sensitive layer has a sensitivity maximum within the range of 700 to 1000 nm, preferably 720 to 900 nm.

With respect to the arrangement of the invisible light-sensitive layer of the silver halide color photographic print material according to the invention, the UV-sensitive layer is provided preferably between a light sensitive silver halide emulsion layer farthest from the support and a protective layer, e.g., between a protective layer and a U-absorbing layer; and the infrared-sensitive layer is provided preferably between a red-sensitive layer and the support.

With respect to intended spectral sensitivity of the invisible light-sensitive layer, the UV-sensitive layer can be achieved by controlling halide composition of a silver emulsion. The silver halide emulsion suitable for the UV-sensitive layer includes a silver bromochloride emulsion containing 95 mol % or more chloride and substantially containing no iodide. The infrared-sensitive layer can be achieved by using the spectral-sensitizing dye represented by afore-described formula [I-a] or [I-b] to obtain the intended sensitivity maximum. The sensitizing dye is used in an amount of $1\times10^{-7}$ to $1\times10^{-2}$ mol, and more preferably $1\times10^{-5}$ to $5\times10^{-3}$ mol per mol of silver halide.

As couplers used for forming a dye image in the invisible light-sensitive layer of the silver halide color photographic print material according to the invention are employed a yellow coupler, a magenta coupler, a cyan coupler of an infrared coupler, singly or in combination. Preferred embodiments include a single use of a magenta coupler, single use of an infrared coupler and the use of a mixture of a yellow coupler, a magenta coupler and a cyan coupler.

The silver halide emulsion relating to the silver halide color photographic print material according to the invention comprises any one, including silver chloride, silver bromide, silver bromochloride, silver iodobromide, silver iodochlorobromide and silver iodochloride. Of these is preferred silver bromochloride containing 95 mol % or more chloride and substantially containing no iodide. A silver halide emulsion comprised of silver bromochloride containing 97 mol % or more chloride, and preferably 98 to 99.9 mol % chloride is more preferred in terms of rapid processability and process stability.

The silver halide emulsion advantageously occludes a heavy metal ion. Examples thereof include ions of the 8th to 10th groups metals, such as iron, iridium, platinum, palladium, nickel, rhodium, osmium, ruthenium and cobalt; the 12th group metals such as cadmium, zinc and mercury; ions of lead, rhenium, molybdenum, tungsten, gallium and chromium. Of these are preferred metal ions of iron, iridium, platinum, ruthenium, gallium and osmium. The metal ion is occluded in an amount of $1\times10^{-9}$ to $1\times10^{-2}$ mol, and more preferably $1\times10^{-8}$ to $5\times10^{-5}$ mol per mol of silver halide.

Silver halide grains relating to the invention can have any form. Exemplarily, cubic grains having (100) crystal surfaces are preferred. Further, there can be employed octahedral, tetradecahedral or dodecahedral grains prepared according the methods described in U.S. Pat. Nos. 4,183,756 and 4,225,666; JP-A 55-26589; JP-B 55-42737; and J. Photogr. Sci. Vol.21, 39 (1973). Furthermore, grains having twin plane(s) are also employed. The size of silver halide grains relating to the invention is not specifically limited, and is preferably 0.1 to 1.2 $\mu$m, and more preferably 0.2 to 1.0 $\mu$m. The grain size can be determined using grain projected area or a diameter approximation value. In cases where grains are substantially uniform shape, grain size distribution can be rather exactly represented in terms of the diameter or projected area. With regard to the grain size distribution of the silver halide grains used in the invention are preferable monodisperse grains having a variation coefficient of 0.22 or less, and more preferably 0.15 or less. Specifically, two or more kinds of monodisperse emulsions having a variation coefficient of 0.15 or less are preferably incorporated into the same layer. The variation coefficient, which represents width of the grain size distribution, is defined as follows:

$$\text{Variation Coefficient}=S/R$$

where S represents a standard deviation of grain size distribution, and R represent an average grain size. In cases where silver halide grains are in a spherical form, the grain size is a diameter and in cases where silver halide grains are cubic or in a form other than a spherical form, the grain size is represented in terms of a diameter of a circle having an area equivalent to the grain projected area.

The silver halide emulsion relating to the invention can be prepared according to the method and employing the apparatus each known in the art.

The silver halide emulsion can be chemically sensitized using a gold compound or a chalcogen sensitizer, singly or in combination. As the chalcogen sensitizer is used a sulfur sensitizer, selenium sensitizer or tellurium sensitizer. Of these is preferably used the sulfur sensitized. Examples of the sulfur sensitized include a thiosulfate, an allylthiocarbamate, a thiourea, an allylthioisocyanate, cystine, a p-toluenethiosulfonate, rhodanine and inorganic sulfur. The addition amount of the sulfur sensitizer is optional depending of silver halide emulsions to be applied and is preferably $5\times10^{-10}$ to $5\times10^{-5}$ mol, and more preferably $5\times10^{-8}$ to $3\times10^{-5}$ mol per mol of silver halide. A gold sensitizer is added in the form of a gold complex of chloroauric acid or gold sulfide. Examples of usable ligand compounds include dimethylrhodanine, thiocyanic acid, mercaptotetrazole, and mercaptotriazole. The addition amount of the gold compound is optional, depending of the kind of a silver halide emulsion, the kind of a compound to be used and ripening conditions, and is preferably $1\times10^{-8}$ to $1\times10^{-4}$ mol, and more preferably $1\times10^{-8}$ to $1\times10^{-5}$ mol per mol of silver halide. The silver halide emulsion relating to the invention can be subjected to reduction sensitization.

The silver halide emulsion may be added with an antifoggant or a stabilizer known in the art to prevent fog produced during the process of manufacturing the silver halide photographic material, to reduce fluctuation in photographic performance during storage and to prevent fogging during development. Examples of preferred compounds usable for these purposes include compounds represented by general formula (II) described in JP-A 2-146036 at page 7, lower column, such as Compounds (IIa-1) to (IIa-8) and (IIb-1) to (IIb-7); and compounds such as 1-(3-methoxyphenyl)-5-mercaptotetrazole and 1-(4-ethoxyphenyl)-5-mercaptotetrazole. These compounds can be added at any stage of silver halide grain formation, chemical sensitization, completion of chemical sensitization and preparation of a coating solution. When conducting chemical sensitization in the presence of these compounds, the compound is preferably used an amount of $1\times10^{-5}$ to $5\times10^{-4}$ mol per mol of silver halide. The compound is preferably added in an amount of $1\times10^{-6}$ to $1\times10^{-2}$ mol, and more preferably $1\times10^{-5}$ to $5\times10^{-3}$ mol per mol of silver halide at the time when completion of chemical sensitization. In cases where adding the compound to a silver halide emulsion layer at the stage of preparing a coating solution, the compound is preferably added in an amount of $1\times10^{-6}$ to $1\times10^{-1}$ mol, and more preferably $1\times10^{-5}$ to $1\times10^{-2}$ mol per mol of silver halide. In cases where adding to a layer other than the silver halide emulsion layer, the compound is added in an amount of $1\times10^{-9}$ to $1\times10^{-3}$ mol per $m^2$ of the layer.

In the silver halide photographic material relating to the invention are employed dyes having absorption at various wavelengths for the purpose of antiirradiation and antihalation. A variety of compounds are employed for this purpose. Preferred dyes having absorption in the visible light region include dyes AI-1 to 11 described in JP-A 3-251840 at page 308 and dyes described in JP-A 6-3770. In the photographic material is also preferably employed a brightening agent to improve whiteness, including compounds represented by formula II described in JP-A 2-232652.

Spectral-sensitizing dyes known in the art can be employed in the silver halide photographic material relating to the invention. Preferred examples thereof include blue-sensitive sensitizing dyes, BS-1 to 8 described in JP-A 3-251840 at page 28, green-sensitive sensitizing dyes GS-1 to 5 described in ibid. at page 28, and red-sensitive sensitizing dyes RS-1 to 8 described in ibid. at page 29. These blue-sensitive, green-sensitive and red-sensitive sensitizing dyes and infrared-sensitive sensitizing dyes are preferably used in combination with supersensitizers SS-1 to SS-9 described in JP-A 4-285950 at page 8–9 and compounds S-1 to S-17 described in JP-A 5-66515 at page 15–17.

Couplers usable in the silver halide photographic material relating to the invention, other than infrared couplers described above, include any compound capable of forming, upon coupling with an oxidation product of a color developing agent, a coupling reaction product having a absorption maximum at wavelengths of 340 nm or more. Thus, exemplary examples thereof include a yellow dye forming coupler having a absorption maximum at wavelengths of 350 to 500 nm, a magenta dye forming coupler having a absorption maximum at wavelengths of 500 to 600 nm and a cyan dye forming coupler having a absorption maximum at wavelengths of 600 to 750 nm.

When oil in water type emulsifying dispersion is used to incorporate coupler of other organic compounds used in the silver halide photographic material, these compounds are conventionally dissolved in a water-insoluble high boiling organic solvent having a boiling point of 150° C. or higher, optionally in combination with a low boiling and/or water-soluble organic solvent, and is emulsifiedly dispersed in a hydrophilic medium such as a gelatin aqueous solution, using a surfactant. There can be employed, as a dispersing means, a stirrer, a homogenizer, colloid mill, flow-jet mixer and ultrasonic homogenizer. After completing dispersion or concurrently therewith, the low boiling solvent may be removed. Preferred examples of high boiling solvents used for dissolving a coupler to be dispersed, include phthalic acid esters such as dioctyl phthalate, diisodecyl phthalate and dibutyl phthalate; and phosphoric acid esters such as tricresyl phosphate and trioctyl phosphate. A high boiling solvent having a dielectric constant of 3.5 to 7.0 is preferably employed. Two or more kinds of high boiling solvents may be used in combination. Instead of the method by use of the high boiling solvent or in combination therewith, an alternative emulsifying dispersion method can applied, in which a water-insoluble and organic solvent-soluble polymeric compound is dissolved in a low boiling and/or water-soluble organic solvent and dispersed in a hydrophilic medium such as a gelatin aqueous solution using a surfactant and various dispersing means. Examples of the water-insoluble and organic solvent-soluble polymeric compound include poly (N-t-butylacrylamide). Preferred surfactants used for dispersing photographic adjuvants and adjusting surface tension at the stage of coating include compounds containing a hydrophobic group having 8 to 30 carbon atoms and a sulfonic acid or its salt group, such as compounds A-1 to A-11 described in JP-A 64-26854. There is also preferably employed a surfactant containing fluorine-substituted alkyl group.

An anti-fading additive can be used in combination with the couplers described above to prevent discoloring of dye images, due to light, heat or humidity. Preferred compounds used for magenta dyes include phenyl ether type compounds represented by formula I and II described in JP-A 2-66541; phenol type compounds represented by formula B described in JP-A 3-174150; amine type compounds represented by formula A described in JP-A 64-90445; and metal complex compounds represented by formula XII, XIII, XIV and XV described in JP-A 62-182741. Preferred compounds used for yellow and cyan dyes include compounds represented by formula I' described in JP-A 1-196049 and compounds represented by formula II described in JP-A 5-11417.

To shift the dye absorption wavelength can be employed a compound (d-11) described in JP-A 4-114154 at page 9 and a compound (A'-1) described in ibid. at page 10. Further, there can be employed a compound capable of releasing a fluorescent dye described in U.S. Pat. No. 4,774,187.

In the silver halide photographic material relating to the invention, a compound capable of reacting with an oxidized color developing agent is preferably incorporated into a layer between a sensitive layer and another sensitive layer to prevent color contamination or incorporated into a silver halide emulsion layer to prevent fogging. Preferred examples of such a compound include hydroquinone derivatives, and preferably dialkylhydroquinones such as 2,5-di-t-octylhydroquinone. Particularly preferred compounds are those represented by formula II described in JP-A 4-133056 and specifically, compounds II-1 to II-14 described in ibid. at page 13-14, and compound 1 described in ibid at page 17.

A UV absorbent may also be incorporated into the photographic material to prevent static fogging and improve light fastness of dye images. Preferred UV absorbents are benzotriazoles, specifically including compounds represented by formula III-3 described in JP-A 1-250944; compounds represented by formula III described in JP-A 64-66646; compounds UV-lL to UV-27L described in 63-187240; compounds represented by formula I described in JP-A 4-1633; and compounds represented by formulas (I) and (II).

As a binder is advantageously employed gelatin in the silver halide photographic material relating to the invention. Furthermore, there can optionally be employed hydrophilic colloids including gelatin derivatives and graft polymers of gelatin and another polymer, proteins other than gelatin, saccharide derivatives, cellulose derivatives and synthetic hydrophilic polymeric materials such homo- or co-polymers.

A vinylsulfon type hardener and chlorotriazine type hardener are employed, as a hardener for the binder, singly or in combination thereof, including preferred compounds described in JP-A 61-249054 and 61-245153. To prevent the propagation of mold or bacteria which adversely affect photographic performance and image storage stability, an antiseptic agent or antimold is incorporated to a colloidal layer, as described in JP-A 3-157646. To improve surface physical property of the photographic material and the processed material, a lubricant and matting agent described in JP-A 6-118543 and 2-73250 are also preferably incorporated to a protective layer.

Any support can be employed in the silver halide photographic material relating to the invention, preferably including polyethylene or polyethylene terephthalate-coated payer, a paper support made of natural pulp or synthetic pulp, polyvinyl chloride sheet, polypropylene or polyethylene terephthalate support, which may contain a white pigment, and baryta paper. As the white pigment used in the support are employed organic and/or inorganic white pigments, preferably, inorganic white pigments. Examples thereof include alkaline earth metal sulfates such as barium sulfate, alkaline earth metal carbonates such as calcium carbonate, silicate such as fine silicate powder and synthetic silicates, calcium silicate, alumina, alumina hydrate, titanium oxide, zinc oxide, talc and clay. Barium sulfate and titanium oxide are preferably employed as a white pigment. The white pigment to be incorporated into a water-proof resin surface layer of the support is preferably in an amount of 13% by weight or more, and more preferably 15% by weight or more to enhance sharpness. Dispersibility of the white pigment in the water-proof resin layer of the support can be measured according to the method described in JP-A 2-28640. The dispersing degree measured according to this method is preferably 0.20 or less and more preferably 0.15 or less, in terms of a coefficient of variation described in the JP-A described above. The center-line mean roughness (Sra) of the support is preferably 0.15 $\mu$m or less and more preferably 0.12 $\mu$m or less in terms of glossiness. For the purpose of adjusting spectral reflection density balance of the white background to enhance whiteness, a small amount of a blueing agent or red-coloring agent such as ultramarine or oil-soluble dyes is preferably incorporated into a white pigment containing water-proof resin layer of the support or a coated hydrophilic layer.

After the surface of the support optionally subjected to corona discharge, UV-ray irradiation or flame treatment, the silver halide photographic material according to the invention is coated directly or through a sublayer (i.e., one or more sublayers for enhancing adhesion property, antistatic property, dimensional stability, abrasion resistance, hardness, antihalation, friction property and/or other properties of the support surface) . When coating a silver halide emulsion, a thickening agent can be employed to enhance coatability. Useful coating methods are specifically extrusion coating or curtain coating, in which two or more layers can be simultaneously coated.

To form a photographic image using the silver halide photographic material according to the invention, an image recorded on a negative can be optically formed on a silver halide photographic material to be printed; after converted to digital information, the image can be formed on a CRT (cathode ray tube) and further printed on the silver halide photographic material, or the image can be printed by scanning with laser based on the digital information.

The present invention can be preferably applied to a silver halide photographic material containing no developing agent, and specifically to the photographic material capable of forming images for direct appreciation, including a color paper, color reversal paper, positive image forming photographic material, photographic material for use in display and photographic material used for color proof, and specifically applied to a photographic material having a reflection support.

As a color developing agent usable in the present invention can be employed aromatic primary amine compounds. Examples thereof include the following compounds:

CD-1) N,N-Diethyl-p-phenylenediamine

CD-2) 2-Amino-5-diethylaminotoluene

CD-3) 2-Amino-5-(N-ethyl-N-laulylamino)toluene

CD-4) 4-[N-ethyl-N-(β-hydroxyethyl)amino]aniline

CD-5) 2-Methyl-4-[N-ethyl-N-(β-hydroxyethyl)-amino] aniline

CD-6) 4-Amino-3-methyl-N-ethyl-N-[β-(methanesulfonamido)ethyl]aniline

CD-7) N-(2-Amino-5-diethylaminophenylethyl)-methanesulfonamide

CD-8) N,N-Dimethyl-p-phenylenediamine

CD-9) 4-Amino-3-methyl-N-ethyl-N-methoxyethylaniline

CD-10) 4-Amino-3-methyl-N-ethyl-N-(β-ethoxyethyl)-aniline

CD-11) 4-Amino-3-methyl-N-ethyl-N-(γ-hydroxypropyl)-aniline

A color developing solution containing a color developing agent described above can be used at any pH, and preferably at a pH of 9.5 to 13.0, and more preferably at a pH of 9.8 to 12.0, in terms of rapid access. The color developing temperature is preferably not lower than 35° C. and not higher than 70° C. The higher the developing temperature, the rapid access can be achieved. However, the temperature which is too high, is not preferable in terms of stability of a processing solution, and processing at a temperature of 37 to 60° C. is preferred. The color developing time is conventionally 3 min. 30 sec or so, but in the invention, is preferably 40 sec. or less, and more preferably 25 sec. or less. In addition to the color developing agent, the color developing solution further contains known developer component compounds, including an alkaline agent having a pH buffering action, development inhibitor such as a chloride ion or benzotriazole, a preservative and a chelating agent.

The silver halide photographic material, after color development, is further subjected to bleaching and fixing. The bleaching and fixing may be simultaneously carried out. After fixing, the photographic material is further subjected to washing. Instead of washing, the photographic material may be subjected to stabilization. An apparatus for processing the silver halide photographic material usable in the invention may be roller transport type one, in which the photographic material is carried by putting it between rollers arranged in the processing tank; or endless belt type one, in which the photographic material is carried by fixing it with a belt. There can also employed a spray type, in which a processing solution supplied to a slit-formed processing bath and the photographic material carried therein; a web type, in which the photographic material is brought into contact with a carrier impregnated with a processing solution; and a viscous processing solution type. In cases where a large amount of photographic material are processed, the photographic material are continuously processed using an automatic processor. In this case, the less the replenishing rate, the more preferable. One preferred replenishment is the use of solid processing composition in a tablet form, in terms of environment protection, as described in Kokai Giho (Technical report publication) 94-16935.

EXAMPLES

The present invention is further described based on examples, but embodiments of the invention are not limited to these examples.

Example 1

The following layers having the composition described below were coated on a subbed cellulose triacetate film support in this order from the support to prepare a multi-layered color photographic material Sample 101.

In the following examples, the addition amount in the silver halide photographic material was expressed in g per $m^2$, unless otherwise noted. The coating amount of silver halide or colloidal silver was converted to silver. With respect to a sensitizing dye, it was expressed in mol per mol of silver halide contained in the same layer.

| | |
|---|---|
| **1st Layer; Antihalation Layer** | |
| Black colloidal silver | 0.08 |
| UV absorbent (UV-1) | 0.30 |
| High boiling solvent (Oil-1) | 0.17 |
| Gelatin | 1.59 |
| **2nd Layer; Interlayer** | |
| High boiling solvent (Oil-2) | 0.01 |
| Gelatin | 1.27 |
| **3rd layer; Low speed red-sensitive layer** | |
| Silver iodobromide emulsion A | 0.80 |
| Sensitizing dye (SD-1) | $5.0 \times 10^{-5}$ |
| Sensitizing dye (SD-2) | $9.0 \times 10^{-5}$ |
| Sensitizing dye (SD-3) | $1.9 \times 10^{-5}$ |
| Sensitizing dye (SD-4) | $2.0 \times 10^{-4}$ |
| Sensitizing dye (SD-5) | $2.8 \times 10^{-4}$ |
| Cyan coupler (C-1) | 0.42 |
| Colored cyan coupler (CC-1) | 0.02 |
| High boiling solvent (Oil-1) | 0.35 |
| Gelatin | 1.02 |
| **4th Layer; Medium Speed Red-sensitive Layer** | |
| Silver iodobromide emulsion E | 0.40 |
| Sensitizing dye (SD-3) | $1.8 \times 10^{-5}$ |
| Sensitizing dye (SD-4) | $2.4 \times 10^{-4}$ |
| Sensitizing dye (SD-5) | $4.5 \times 10^{-4}$ |
| Cyan coupler (C-1) | 0.26 |
| Colored cyan coupler (CC-1) | 0.05 |
| DIR compound (D-1) | 0.01 |
| High boiling solvent (Oil-1) | 0.31 |
| Gelatin | 0.78 |
| **5th Layer; High Speed Red-sensitive Layer** | |
| Silver iodobromide emulsion G | 1.51 |
| Sensitizing dye (SD-3) | $1.8 \times 10^{-5}$ |
| Sensitizing dye (SD-4) | $3.1 \times 10^{-4}$ |
| Sensitizing dye (SD-5) | $2.7 \times 10^{-4}$ |
| Cyan coupler (C-2) | 0.11 |
| Colored cyan coupler (CC-1) | 0.02 |
| DIR compound (D-2) | 0.04 |
| High boiling solvent (Oil-1) | 0.17 |
| Gelatin | 1.15 |
| **6th Layer; Interlayer** | |
| Yellow coupler (Y-1) | 0.02 |
| Yellow coupler (Y-2) | 0.06 |
| High boiling solvent (Oil-2) | 0.02 |
| High boiling solvent (Oil-1) | 0.17 |
| Gelatin | 0.69 |
| **7th Layer; Interlayer** | |
| Gelatin | 0.80 |
| **8th Layer; Low Speed Green-sensitive Layer** | |
| Silver iodobromide emulsion B | 0.21 |
| Sensitizing dye (SD-1) | $5.9 \times 10^{-5}$ |
| Sensitizing dye (SD-6) | $3.1 \times 10^{-4}$ |
| Sensitizing dye (SD-9) | $1.8 \times 10^{-4}$ |
| Sensitizing dye (SD-11) | $5.6 \times 10^{-5}$ |
| Magenta coupler (M-1) | 0.20 |
| Colored magenta coupler (CM-1) | 0.05 |
| DIR compound (D-1) | 0.02 |
| High boiling solvent (Oil-2) | 0.27 |
| Gelatin | 1.34 |
| **9th Layer; Medium Speed Green-sensitive Layer** | |
| Silver iodobromide emulsion E | 0.82 |
| Sensitizing dye (SD-1) | $5.0 \times 10^{-5}$ |
| Sensitizing dye (SD-6) | $2.7 \times 10^{-4}$ |
| Sensitizing dye (SD-9) | $1.7 \times 10^{-4}$ |
| Sensitizing dye (SD-11) | $4.8 \times 10^{-5}$ |
| Magenta coupler (M-1) | 0.21 |
| Colored magenta coupler (CM-1) | 0.05 |
| DIR compound (D-4) | 0.02 |

-continued

| | |
|---|---|
| High boiling solvent (Oil-2) | 0.33 |
| Gelatin | 0.89 |
| **10th Layer; High Speed Green-sensitive Layer** | |
| Silver iodobromide emulsion D | 0.99 |
| Sensitizing dye (SD-6) | $3.6 \times 10^{-4}$ |
| Sensitizing dye (SD-7) | $7.0 \times 10^{-5}$ |
| Sensitizing dye (SD-8) | $4.8 \times 10^{-5}$ |
| Sensitizing dye (SD-11) | $6.2 \times 10^{-5}$ |
| Magenta coupler (M-1) | 0.05 |
| Colored magenta coupler (CM-2) | 0.03 |
| High boiling solvent (Oil-2) | 0.25 |
| Gelatin | 0.88 |
| **11th Layer; Interlayer** | |
| High boiling solvent (Oil-1) | 0.25 |
| gelatin | 0.50 |
| **12th Layer; Yellow Filter Layer** | |
| Yellow colloidal silver | 0.07 |
| Antistaining agent (SC-1) | 0.12 |
| High boiling solvent (Oil-2) | 0.16 |
| Gelatin | 1.00 |
| **13th Layer; Interlayer** | |
| Gelatin | 0.36 |
| **14th Layer; Low Speed Blue-sensitive Layer** | |
| Silver iodobromide emulsion B | 0.37 |
| Sensitizing dye (SD-10) | $5.6 \times 10^{-4}$ |
| Sensitizing dye (SD-11) | $2.0 \times 10^{-4}$ |
| Sensitizing dye (SD-13) | $9.8 \times 10^{-5}$ |
| Yellow coupler (Y-1) | 0.39 |
| Yellow coupler (Y-2) | 0.14 |
| DIR compound (D-5) | 0.03 |
| High boiling solvent (Oil-2) | 0.11 |
| Gelatin | 1.02 |
| **15th Layer; Medium Speed Blue-sensitive Layer** | |
| Silver iodobromide emulsion D | 0.46 |
| Silver iodobromide emulsion E | 0.10 |
| Sensitizing dye (SD-10) | $5.3 \times 10^{-4}$ |
| Sensitizing dye (SD-11) | $1.9 \times 10^{-4}$ |
| Sensitizing dye (SD-13) | $1.1 \times 10^{-5}$ |
| Yellow coupler (Y-1) | 0.28 |
| Yellow coupler (Y-2) | 0.10 |
| DIR compound ((D-5) | 0.05 |
| High boiling solvent (Oil-2) | 0.08 |
| Gelatin | 1.12 |
| **16th Layer; High Speed Blue-sensitive Layer** | |
| Silver iodobromide emulsion D | 0.04 |
| Silver iodobromide emulsion G | 0.28 |
| Sensitizing dye (SD-11) | $8.4 \times 10^{-5}$ |
| Sensitizing dye (SD-12) | $2.3 \times 10^{-4}$ |
| Yellow coupler (Y-1) | 0.04 |
| Yellow coupler (Y-2) | 0.12 |
| High boiling solvent (Oil-2) | 0.03 |
| Gelatin | 0.85 |
| **17th Layer; First Protective Layer** | |
| Silver iodobromide emulsion (Av. grain size of 0.04 $\mu$m, 4 mol % iodide) | 0.30 |
| UV absorbent (UV-2) | 0.03 |
| UV absorbent (UV-3) | 0.015 |
| UV absorbent (UV-4) | 0.015 |
| UV absorbent (UV-5) | 0.015 |
| UV absorbent (UV-6) | 0.10 |
| High boiling solvent (Oil-1) | 0.44 |
| High boiling solvent (Oil-3) | 0.07 |
| Gelatin | 1.35 |
| **18th Layer; Second Protective Layer** | |
| Alkali-soluble matting agent (Av. 2 $\mu$m) | 0.15 |
| Polymethylmethacrylate (Av. 3 $\mu$m) | 0.04 |
| Lubricant (WAX-1) | 0.02 |
| Gelatin | 0.54 |

In addition to the above composition were added coating aid compounds (SU-1, 2, 3 and 4), viscosity-adjusting agent (V-1), hardener (H-1 and 2), stabilizer (ST-1), fog restrainer (AF-1 and 2), AF-3 comprising two kinds of weight-averaged molecular weights of 10,000, and 1.100,000, dyes (AI-1, 2 and 3), compounds (FS-1 and 2) and antimold (DI-1).
Al-1
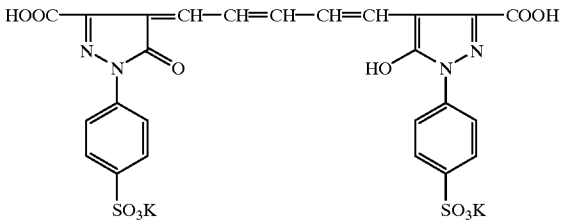
Al-2
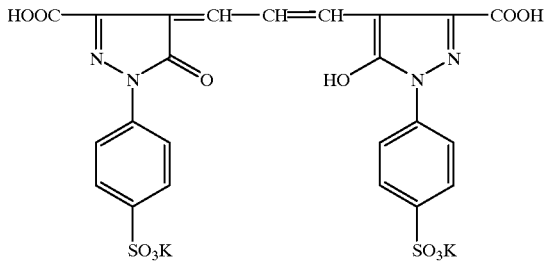
Al-3
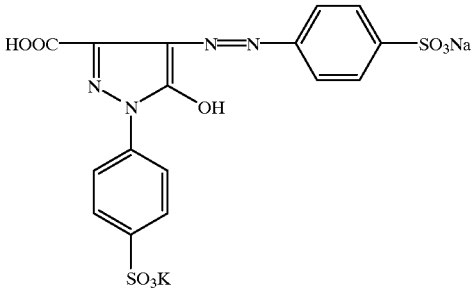
V-1
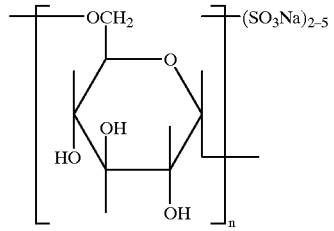
Weight-averaged molecular weight: 120,000
C-1
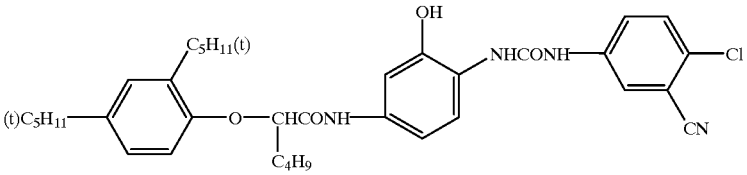
C-2
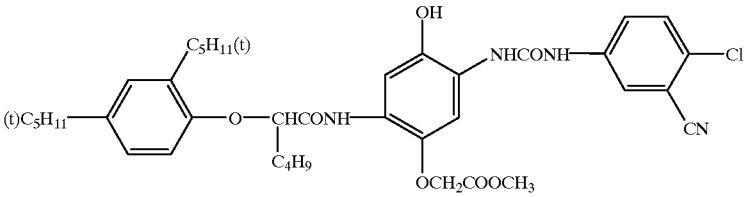
M-1
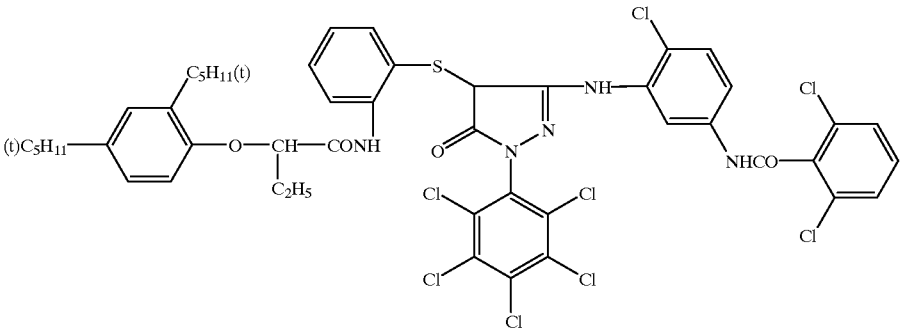

-continued
M-2
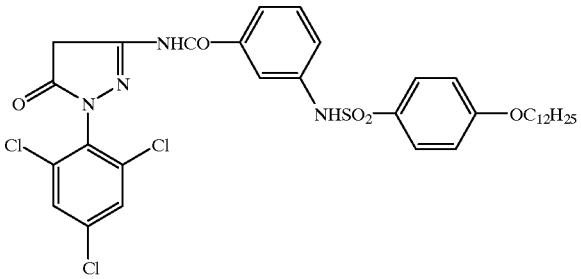
Y-1
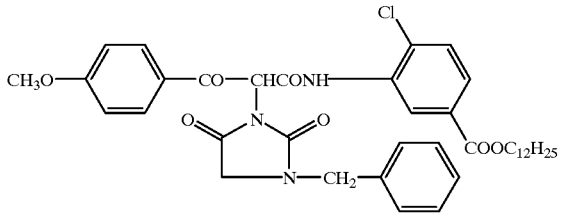
Y-2
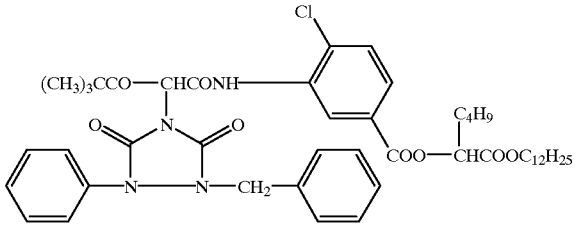
CC-1
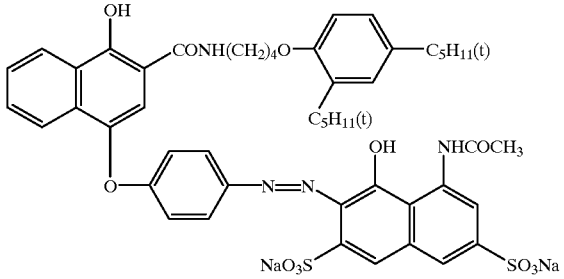
CM-1
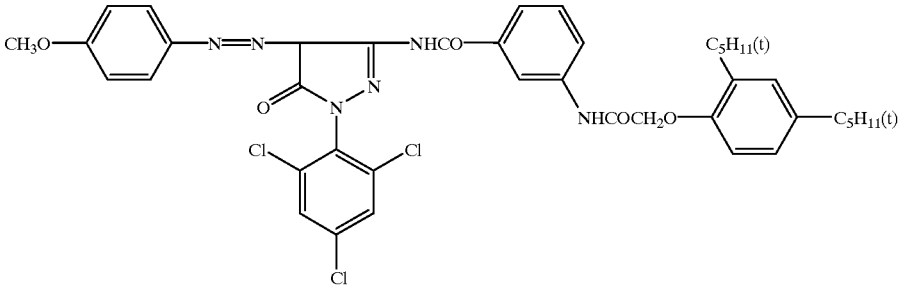
CM-2
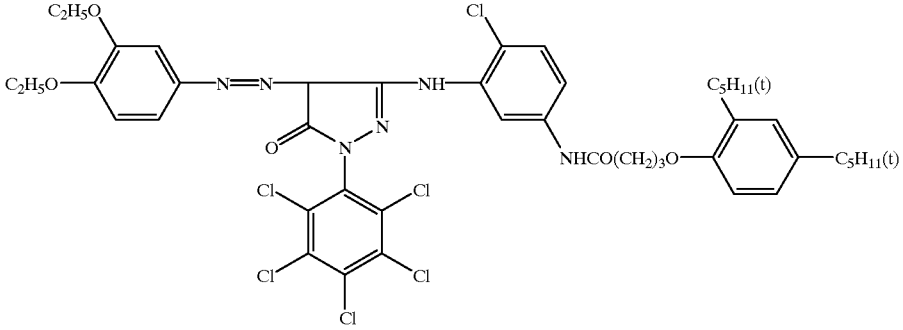

-continued
D-1
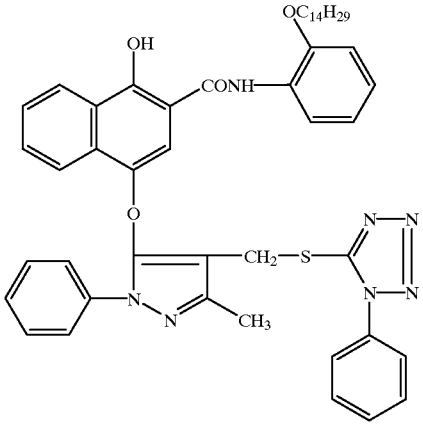
D-2
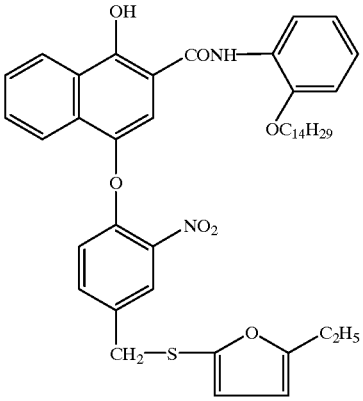
D-4
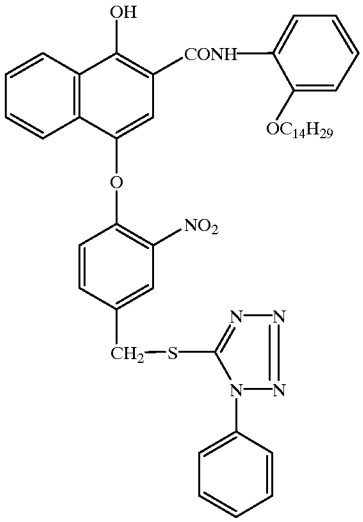
D-5
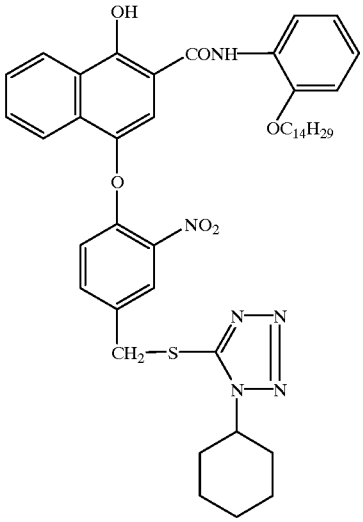
Oil-1
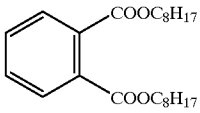
Oil-2
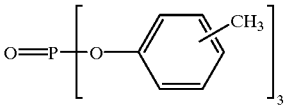
Oil-3
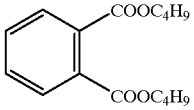
SC-1
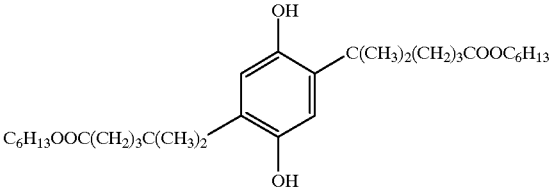
SD-1
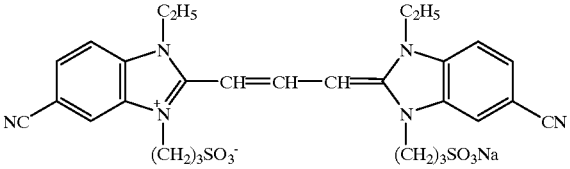
SD-2
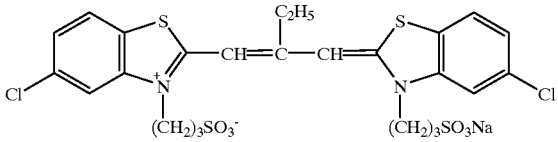

-continued
SD-3
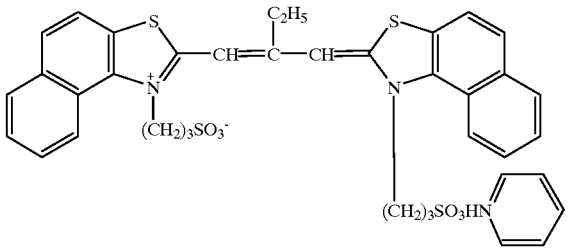
SD-4
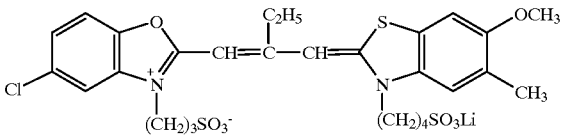
SD-5
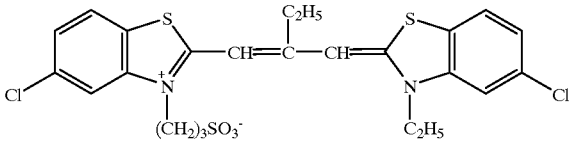
SD-6
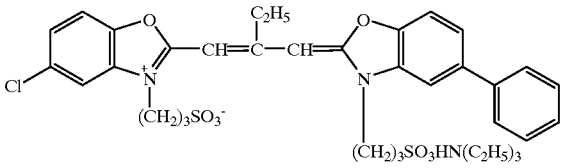
SD-7
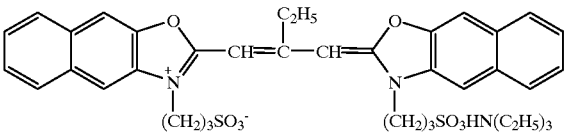
SD-8
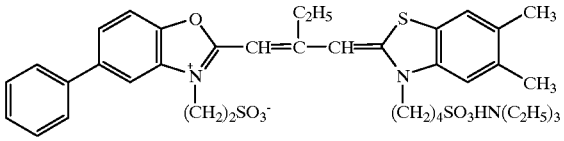
SD-9
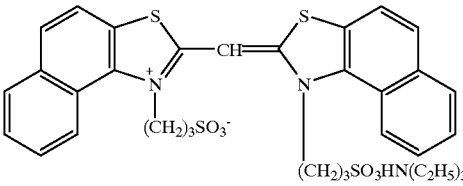
SD-10
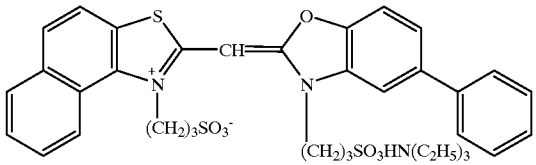
SD-11
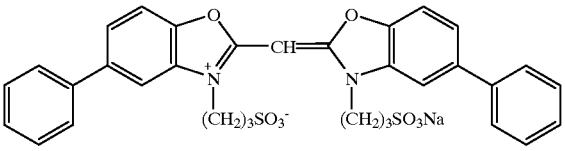
SD-12
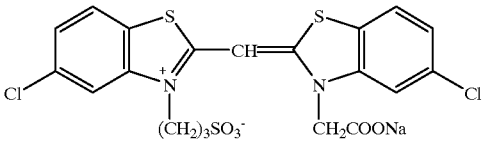
SD-13
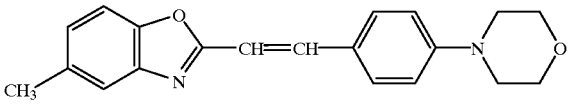
UV absorbent
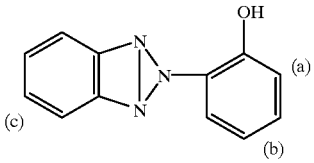
| | (a) | (b) | (c) |
|---|---|---|---|
| UV-1 | —$C_{12}H_{25}$ | —$CH_3$ | —H |
| UV-2 | —H | —(t)$C_4H_9$ | —H |
| UV-3 | —(t)$C_4H_9$ | —(t)$C_4H_9$ | —H |
-continued
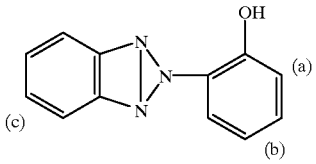
| | (a) | (b) | (c) |
|---|---|---|---|
| UV-4 | —(t)$C_4H_9$ | —$CH_3$ | —Cl |
| UV-5 | —(t)$C_4H_9$ | —(t)$C_4H_9$ | —Cl |

UV-6

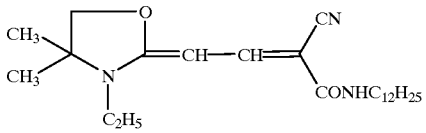

WAX-1

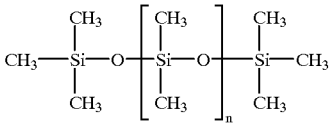

Weight-averaged molecular weight: 3,000

SU-1

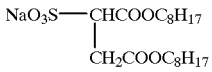

SU-2

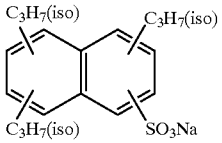

SU-3

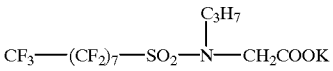

SU-4

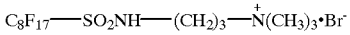

FS-1

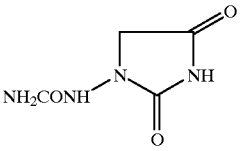

FS-2

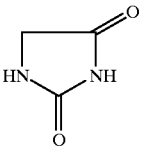

H-1

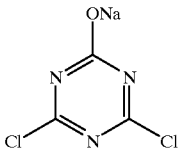

H-2

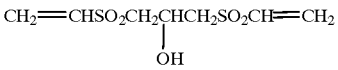

ST-1

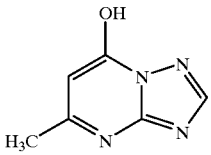

-continued

AF-1

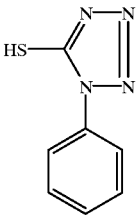

AF-2

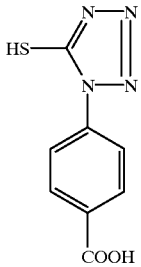

AF-3

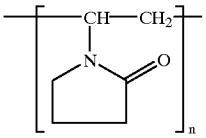

Weight-averaged molecular weight: 10,000

Weight-averaged molecular weight: 100,000

DI-1 (Mixure)

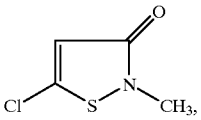

(A)

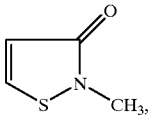

(B)

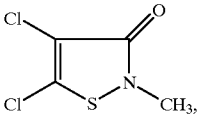

(C)

A:B:C = 50:46:4 (Molar ratio)

Emulsions used in the above sample are as follows, in which an average grain size is represented as calculated in terms of a cubic grain. Each of the emulsions was optimally subjected to gold-sulfur-selenium sensitization.

| Emulsion | Av. AgI content (mol %) | Av. grain size (μm) | Crystal habit | Diameter/thickness ratio |
|---|---|---|---|---|
| A | 2.0 | 0.32 | Regular* | 1.0 |
| B | 6.0 | 0.42 | Twinned tabular* | 4.0 |
| D | 8.0 | 0.70 | Twinned tabular | 5.0 |
| E | 6.0 | 0.60 | Twinned tabular | 4.0 |

-continued

| Emulsion | Av. AgI content (mol %) | Av. grain size (μm) | Crystal habit | Diameter/thickness ratio |
|---|---|---|---|---|
| F | 2.0 | 0.42 | Twinned tabular | 4.0 |
| G | 8.0 | 0.90 | Twinned tabular | 3.0 |

Silver iodobromide emulsions A, B, and F each contain iridium of $1\times10^{-7}$ mol/mol Ag.

Sample 102 was prepared in the same manner as Sample 1-1, except that the 19th layer of an infrared-sensitive layer having the following composition was provided between the 2nd and 3rd layers of Sample 101.

| 19th Layer; Infrared-sensitive layer | |
|---|---|
| Silver iodobromide emulsion E | 0.15 |
| Silver iodobromide emulsion G | 0.70 |
| Sensitizing dye (2-9) | $2.0 \times 10^{-4}$ |
| Infrared coupler (III-5) | 0.20 |
| High boiling solvent (Oil-1) | 0.34 |
| Gelatin | 0.90 |

Sample 103 was prepared in the same manner as Sample 102, except that sensitizing dye (2-4) of the 19th layer was changed to dye (2-4) and the layer was provided between the 17 and 18 layers. Sample 104 was prepared in the same manner as Sample 101, except that a UV-sensitive layer was provided between the 17 and 18 layers.

| 20th Layer; UV-sensitive layer | |
|---|---|
| Silver bromochloride emulsion H (Twinned tabular grains containing 80 mol % chloride and having an average size of 0.6 μm and a ratio of deameter/thickness of 4.0) | 0.20 |
| Silver bromochloride emulsion I (Twinned tabular grains containing 70 mol % chloride and having an average size of 1.0 μm and a ratio of diameter/thickness of 3.0) | 0.20 |
| Infrared coupler (III-5) | 0.20 |
| High boiling solvent (Oil-1) | 0.34 |
| Gelatin | 1.00 |

Determination of Maximum Sensitivity Wavelength of Invisible Light-sensitive Layer Samples having an invisible light-sensitive layer containing an infrared coupler were used as such; and samples having the invisible light-sensitive layer containing no infrared couplers each had an infrared couple (III-5) of 0.20 mol/m$^2$ added. In cases of the invisible light-sensitive layer being a UV-sensitive layer, samples each were subjected to a given amount of exposure to light in the range of 280 to 450 nm at 5 nm intervals, and in cases of the invisible light-sensitive layer being an infrared-sensitive layer, samples were subjected to a given amount of exposure to light in the range of 600 to 1,000 nm at 5 nm intervals. Exposed samples were subjected to color processing (employing CNK-4 available from Konica Corp.) and a spectral sensitivity curve of the invisible light-sensitive layer that gave an infrared (i.e., 800 nm) density of a minimum density plus 0.2 was determined. From obtained spectral sensitivity curve was read the wavelength giving a sensitivity maximum of the invisible light-sensitive layer. As a result, it was proved that Sample 102 exhibited the sensitivity maximum at a wavelength of 690 nm, Sample 103 exhibiting the sensitivity maximum at 750 nm and Sample 104 exhibiting the sensitivity maximum at 340 nm.

These samples were each cut according to the 135-Standard, put into a patrone, loaded into a camera (Konica Hexer, available from Konica Corp.), and photographs were taken outdoors, including a portrait, red tulips, sunflowers, green trees and plants, as well as a lake and distant view of mountains.

Exposed sample films were subjected to conventional processing and read with a scanner according to the method mentioned before. With respect to Samples 102 to 104, assuming $f_R=f_G=f_B=0.5$, invisible image information was mixed with RGB images, and then image data of inventive samples, 102D to 104D were prepared through adjusting luminance distribution and chroma. The image of comparative Sample 101 which was read with a scanner, was denoted as image data 101D. With respect to Sample 103, invisible image information was mixed in accordance with Formula (A) mentioned before and image data 103DA was prepared through adjusting luminance and chroma. With respect to Sample 102, invisible image information was mixed in accordance with Formula (B) mentioned before and image data 102DB was prepared through adjusting luminance and chroma. Obtained final image data was printed on Konica Color Paper QAA6 using a Konica CRT printer. These prints were visually evaluated, based on the following criteria. Further, the prints were sensorily assessed by 10 members of Konica employee families, based on five grades of 1-point (poor) to 5-points (superior), and the average point was shown in Table 1.

In Table 1, evaluation was made based on the following criteria.

Green trees and plants

D: Dark and dull

C: Slightly dull

B: Clear reproduction

A: Light and clear reproduction

Blue sky

C: Ordinary reproduction

B: Clear reproduction

A: Extremely clear reproduction

Red tulip

C: Ordinary reproduction

B: Clear reproduction

A: Reproduction with detailed tone of flower leaves and cores

Distant mountain view

D: Dull reproduction

C: Slightly dull reproduction

B: Clear reproduction

A: Clear and high-contrasty rendering

Flesh skin tone reproduction

C: Ordinary

B: More natural reproduction

A: light and stable reproduction

TABLE 1

| Image data | Tree's green | Blue sky | Red tulip | Sun-flower | Distant mountain | Flesh tone | Sensory assess point (Av. of 10 members) |
|---|---|---|---|---|---|---|---|
| 101D (Comp.) | D | C | C | C | D | C | 3.5 |
| 102D (Inv.) | C | C | B | C | C | B | 4.0 |
| 103D (Inv.) | B | B | C | B | B | C | 4.4 |
| 104D (Inv.) | C | C | C | A | D | C | 4.2 |
| 102DB (Inv.) | C | C | A | C | C | A | 4.3 |
| 103DA (Inv.) | A | A | B | B | A | B | 4.7 |

As can be seen from Table 1, inventive samples earned superior sensory assess points to the comparative sample. It was shown that selecting various wavelengths of the sensitivity maximum of the invisible light-sensitive layer led to superior image rendering in green trees, distant view, flower rendering and flesh skin tone reproduction, which were not achieved in the comparative sample. Specifically, Samples 102DB and 103DA, in which a specified method was applied to mix the invisible image information with BGR image informations, provided further superior images.

Example 2

Sample 105 was prepared in the same manner as Sample 103, except that a infrared coupler (III-5) used in the 19th layer was removed. Samples 101 to 105 were subjected to Processing II in which bleaching was omitted or Processing III in which bleaching and fixing were both omitted, and then, obtained images were read with a scanner in a manner similar to Example 1. With respect to Sample 105, a invisible image information was calculated from a silver image information and then two kinds of image data were prepared in a manner similar to Sample 103 and printed using a Konica CRT printer.

As a result, even in either Processing II or Processing III, superior effects of the invention were confirmed, similarly to Example 1, compared to prints from Sample 101. Furthermore, prints obtained from Sample 105 provided results similar to prints obtained from Sample 103.

Example 3

High density polyethylene was laminated on both sides of paper pulp having a weight of 180 g/m$^2$ to prepare a paper support. Moreover, on the side for coating an emulsion layer, was laminated fused polyethylene containing a dispersion of a surface-treated anatase type titanium oxide of 15 percent by weight. The reflection support was subjected to corona discharging and a gelatin subbing was then performed. Furthermore, each layer having compositions in the following was coated to prepare a silver halide photographic material Sample 301.

1st Layer Coating Solution

To 23.4 g of a yellow coupler (Y-1), 3.34 g of each of dye image stabilizers (ST-1), (ST-2) and (ST-5), 0.34 g of an antistaining agent (HQ-1), 5.0 g of an image stabilizer, 3.33 g of a high boiling solvent (DBP) and 1.67 g of a high boiling solvent (DNP) was added 60 ml of ethyl acetate. The solution was dispersed in 220 ml of a 10% gelatin aqueous solution containing 20 ml of a 20% surfactant (SU-1) solution, using an ultrasonic homogenizer to obtain an emulsified yellow coupler dispersion. The dispersion was mixed with a blue-sensitive silver halide emulsion prepared according to the condition described below to obtain a 1st layer coating solution.

Coating solutions of the 2nd layer to the 7th layer were prepared in a manner similar to the 1st layer coating solution, so as to render coating amount as described in the following. Hardeners (H-1) and (H-2) were added. As coating aids, surface active agents (SU-2) and SU-3) were added to control the surface tension. In addition, F-1 was added to each layer so that the total amount became 0.04 g/m$^2$.

| Layer | Composition | Addition Amount (g/m$^2$) |
|---|---|---|
| 7th layer (Protective Layer) | Gelatin | 1.00 |
| | DIDP | 0.002 |
| | DBP | 0.002 |
| | Silicon dioxide | 0.003 |
| 6th layer (UV absorbing layer) | Gelatin | 0.40 |
| | AI-1 | 0.01 |
| | UV absorber (UV-1) | 0.12 |
| | UV absorber (UV-2) | 0.04 |
| | UV absorber (UV-3) | 0.16 |
| | Antistaining agent (HQ-5) | 0.04 |
| | PVP | 0.03 |
| 5th layer (Red-sensitive layer) | Gelatin | 1.30 |
| | Red-sensitive silver bromochloride emulsion (Em-R) | 0.21 |
| | Cyan coupler (C-1) | 0.25 |
| | Cyan coupler (C-2) | 0.08 |
| | Color image stabilizer (ST-1) | 0.10 |
| | Antistaining agent (HQ-1) | 0.004 |
| | DBP | 0.10 |
| | DOP | 0.20 |
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | AI-1 | 0.02 |
| | Antistaining Agent (HQ-5) | 0.10 |
| 3rd layer (Green-sensitive layer) | Gelatin | 1.30 |
| | AI-2 | 0.01 |
| | Green-sensitive silver bromochloride emulsion (Em-G) | 0.14 |
| | Magenta coupler (M-1) | 0.20 |
| | Color image stabilizer (ST-3) | 0.20 |
| | Color image stabilizer (ST-4) | 0.17 |
| | DIDP | 0.13 |
| | DBP | 0.13 |
| 2nd layer (Interlayer) | Gelatin | 1.20 |
| | AI-3 | 0.01 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.04 |
| | DBP | 0.02 |
| | Brightening agent (W-1) | 0.10 |

-continued

| Layer | Composition | Addition Amount (g/m$^{2)}$ |
|---|---|---|
| 1st layer (Blue-sensitive layer) | Gelatin | 1.20 |
| | Blue-sensitive silver bromochloride emulsion (Em-B) | 0.26 |
| | Yellow coupler (Y-1) | 0.70 |
| | Color image stabilizer (ST-1) | 0.10 |
| | Color image stabilizer (ST-2) | 0.10 |
| | Color image stabilizer (ST-5) | 0.10 |
| | Antistaining agent (HQ-1) | 0.01 |
| | Image stabilizer A | 0.15 |
| | DNP | 0.05 |
| | DBP | 0.15 |
| Support | Polyethylene laminated paper containing a small amount of a colorant. | |

Further, the coating amount of silver halide is represented by equivalent converted to silver.

SU-1: sodium tri-i-propylnaphthalenesulfonate

SU-2: sulfosuccinic acid di(2-ethylhexyl) sodium salt

SU-3: sulfosuccinic acid di(2,2,3,3,4,4,5,5-octafluoropentyl) sodium salt

DBP: dibutyl phthalate

DIDP: diisodecyl phthalate

DOP: dioctyl phthalate

DNP: dinonyl phthalate

PVP: polyvinyl pyrrolidone

H-1: tetrakis(vinylsulfonylmethyl)methane

H-2: 2,4-dichloro-6-hydroxy-s-triazine sodium

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-tetradecylhydroquinone

HQ-5: 2,5-di(1,1-dimethyl-4-hexyloxycarbonyl)butylhydroquinone

Image stabilizer: p-t-octyl phenol

Y-1

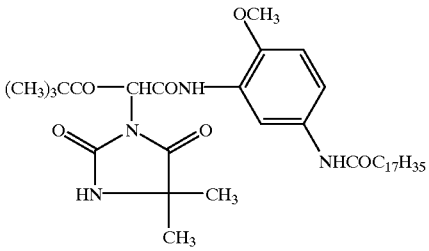

C-1

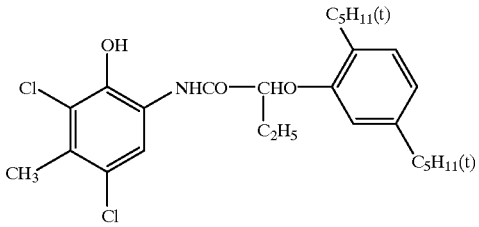

C-2

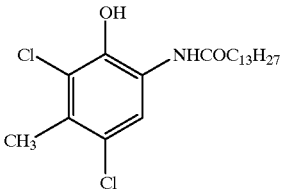

M-1

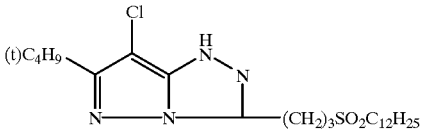

ST-1

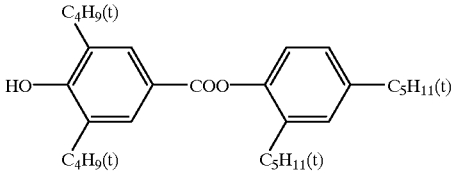

ST-2

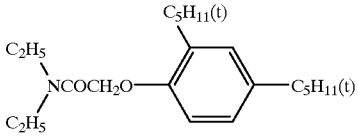

ST-3

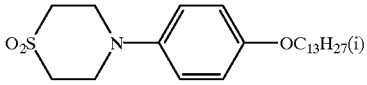

ST-4

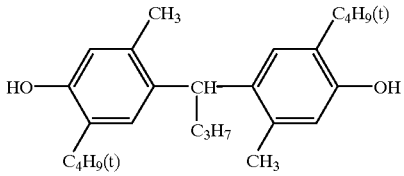

-continued

ST-5

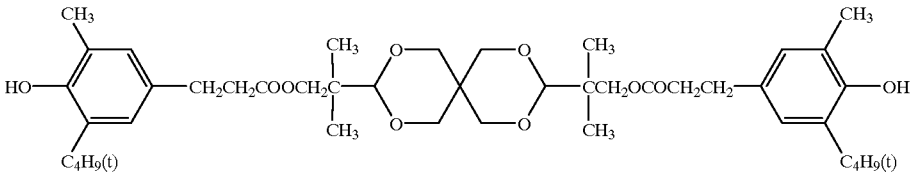

UV-1

UV-2

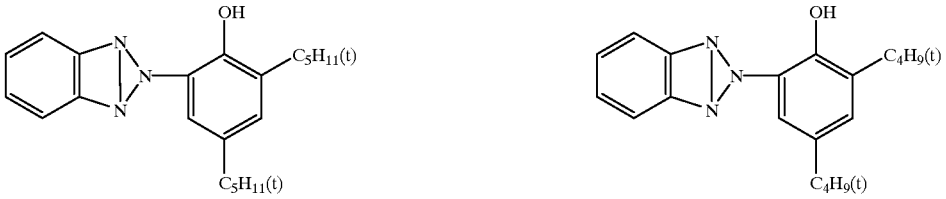

UV-3

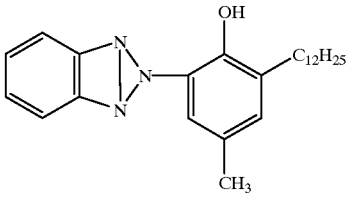

Al-1

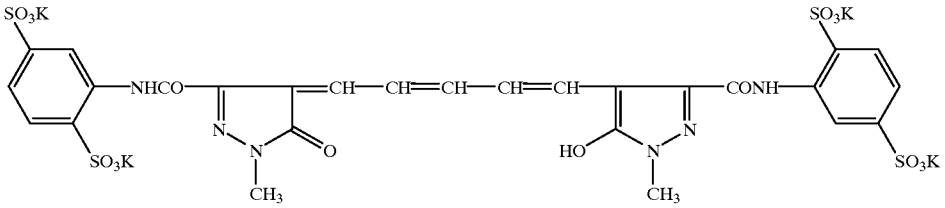

Al-2

Al-3

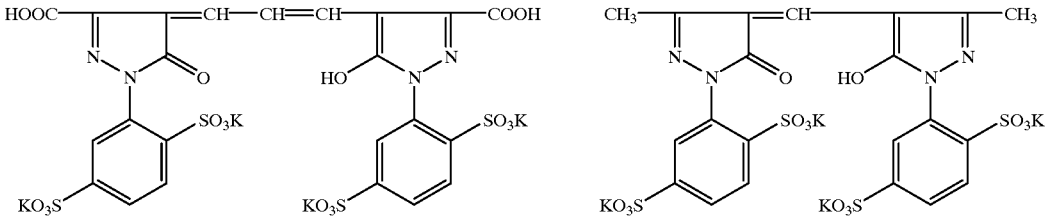

W-1

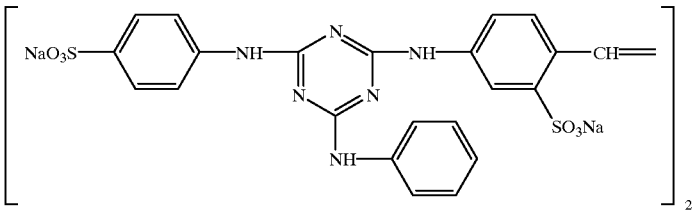

F-1

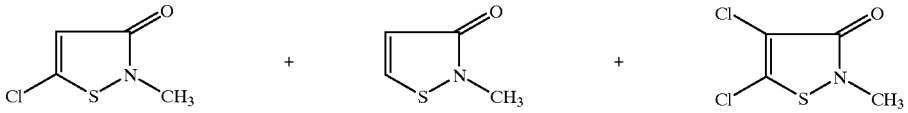

(50%) (46%) (4%) Molar ratio

Preparation of Blue-sensitive Silver Halide Emulsion

To 1 liter of an aqueous 2% gelatin solution heated at 40° C., the following Al Solution and Bi Solution were simultaneously added while controlling at pAg=7.3, pH=3.0, and further, the following Cl Solution and Dl Solution were simultaneously added while being controlled at pAg=8.0 and pH=5.5. At this time, the pAg was controlled according to the method described in Japanese Patent Publication Open to Public Inspection No. 59-45437 and the pH was controlled using sulfuric acid or an aqueous sodium hydroxide solution.

| | |
|---|---|
| (A Solution) | |
| Sodium chloride | 3.42 g |
| Potassium bromide | 0.03 g |
| Water to make | 200 ml |
| (B Solution) | |
| Silver nitrate | 10 g |
| Water to make | 200 ml |
| (C Solution) | |
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water to make | 600 ml |
| (D Solution) | |
| Silver nitrate | 300 g |
| Water to make | 600 ml |

After finishing the addition, soluble salts were removed using an aqueous 5% Demol N (manufactured by Kao Atlas Co.) solution and an aqueous 20% magnesium sulfate solution followed by mixing with an aqueous gelatin solution. Thus, a monodispersed cubic grain emulsion EMP-1 was prepared which had an average grain diameter of 0.71 μm, a variation coefficient of grain diameter distribution of 0.07, and a silver chloride content of 99.5 mol %. Subsequently, a monodispersed cubic grain emulsion EMP-1 B was prepared in the same manner as in the preparation of EMP-1 except that the addition period of A Solution and B Solution, and the addition period of C Solution and D Solution were changed. The EMP-1B had an average grain diameter of 0.64 μm, a variation coefficient of a grain diameter distribution of 0.07, and a silver chloride content of 99.5 mol %.

The above-described EMP-1 was subjected optimally to chemical sensitization at 60° C. using the following compounds. In the same way, EMP-IB was subjected to optimum chemical sensitization. The sensitized EMP-1 and EMP-1B were mixed in a ratio of 1:1 in terms of silver amount and a blue-sensitive silver halide emulsion (Em-B) was obtained.

| | |
|---|---|
| Sodium thiosulfate | 0.8 mg/mole AgX |
| Chloroauric acid | 0.5 mg/mole AgX |
| Stabilizer STAB-1 | $3 \times 10^{-4}$ mole/mole AgX |
| Stabilizer STAB-2 | $3 \times 10^{-4}$ mole/mole AgX |
| Stabilizer STAB-3 | $3 \times 10^{-4}$ mole/mole AgX |
| Sensitizing dye BS-1 | $4 \times 10^{-4}$ mole/mole AgX |
| Sensitizing dye BS-2 | $1 \times 10^{-4}$ mole/mole AgX |

Preparation of Green-sensitive Silver Halide Emulsion

A monodispersed cubic grain emulsion EMP-2 prepared in the same manner as in the preparation of EMP-1 except that the addition period of A Solution and B Solution, and the addition period of C Solution and D Solution were changed. The EMP-2 had an average grain diameter of 0.40 μm, a variation coefficient of 0.08 and a silver chloride content of 99.5 mol %. Next, there was obtained a monodispersed cubic grain emulsion EMP-2B having an average grain diameter of 0.50 μm, a variation coefficient of 0.08 and a silver chloride content of 99.5 mol %. The above-described EMP-2 was subjected to optimum chemical sensitization at 55° C. using the following compounds. EMP-2B was also subjected to chemical sensitization in the same manner. The sensitized EMP-2 and EMP-2B were mixed in a ratio of 1:1 in terms of silver amount and a green-sensitive silver halide emulsion (Em-G) was obtained.

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mole AgX |
| Stabilizer STAB-2 | $3 \times 10^{-4}$ mol/mole AgX |
| Stabilizer STAB-3 | $3 \times 10^{-4}$ mol/mole AgX |
| Sensitizing dye GS-1 | $4 \times 10^{-4}$ mole/AgX |

Preparation of Red-sensitive Silver Halide Emulsion

A monodispersed cubic grain emulsion EMP-3 was prepared in the same manner as in the preparation of EMP-1 except that the addition period of A Solution and B Solution, and the addition period of C Solution and D Solution were changed. The EMP-3 had an average grain diameter of 0.40 μm, a variation coefficient of 0.08 and a silver chloride content of 99.5 mol %. Next, there was also prepared monodispersed cubic grain emulsion EMP-3B having an average grain diameter of 0.38 μm, a variation coefficient of 0.08 and a silver chloride containing ratio of 99.5 mol %. The above-described EMP-3 was subjected to optimum chemical sensitization at 60° C. using the following compounds. EMP-3B was also subjected to chemical sensitization in a similar manner. The sensitized EMP-3 and EMP-3B were mixed in a ratio of 1:1 in terms of silver amount and a red-sensitive silver halide emulsion (Em-R) was obtained.

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mole/mol AgX |
| Stabilizer STAB-2 | $3 \times 10^{-4}$ mole/mol AgX |
| Stabilizer STAB-3 | $3 \times 10^{-4}$ mole/mol AgX |
| Sensitizing dye RS-1 | $1 \times 10^{-4}$ mole/AgX |
| Sensitizing dye RS-2 | $1 \times 10^{-4}$ mole/AgX |

STAB-1: 1-(3-acetoamidophenyl)-5-mercaptotetrazole

STAB-2: 1-phenyl-5-mercaptotetrazole

STAB-3: 1-(4-ethoxyphenyl)-5-mercaptotetrazole

To the red-sensitive emulsion was added SS-1 of $2.0 \times 10^{-3}$ mol per mol of silver halide.

BS-1

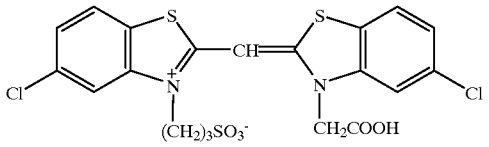

BS-2

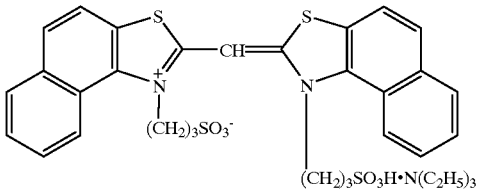

GS-1

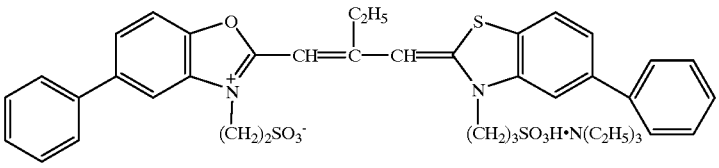

RS-1

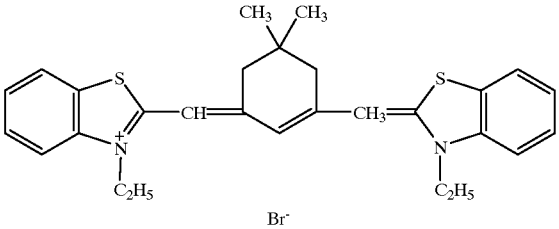

RS-2

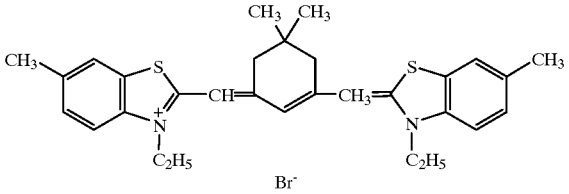

SS-1

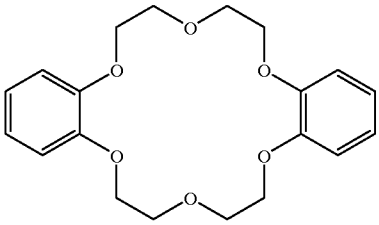

According to the procedure described above, Sample 301 was prepared. Sample 302 was prepared in the same manner as sample 301, except that between the 6th and 7th layers, 6b-th and 6c-th layers were provided in this order from the support.

6b-th Layer: Infrared-sensitive Layer

| | |
|---|---|
| Infrared-sensitive silver bromochloride emulsion* | 0.25 |
| Infrared coupler (III-15) | 0.27 |
| Image stabilizer (ST-1) | 0.10 |
| High boiling solvent (DOP) | 0.30 |
| Gelatin | 1.30 |

6c-th Layer: UV-absorbing Layer

The same constitution as the 6th Layer (UV-absorbing layer).

Preparation of Infrared-sensitive Silver Halide Emulsion

A monodispersed cubic grain emulsion EMP-4 was prepared in the same manner as in the preparation of EMP-1 except that the addition period of A Solution and B Solution, and the addition period of C Solution and D Solution were changed. The EMP-4 had an average grain diameter of 0.40 μm, a variation coefficient of 0.08 and a silver chloride content of 99.5 mol %. Next, there was also prepared monodispersed cubic grain emulsion EMP-4B having an average grain diameter of 0.55 μm, a variation coefficient of 0.08 and a silver chloride containing ratio of 99.5 mol %. The above-described EM-4 was subjected to optimum chemical sensitization at 55° C. using the following compounds. EMP-4B was also subjected to chemical sensitization in a similar manner. The sensitized EMP-4 and EMP-4B were mixed in a ratio of 1:1 in terms of silver amount and a red-sensitive silver halide emulsion (Em-IR) was obtained.

| | |
|---|---|
| Sodium thiosulfate | 1.4 mg/mol AgX |
| Chloroauric acid | 0.8 mg/mol AgX |
| Stabilizer STAB-1 | $3 \times 10^{-4}$ mole/mol AgX |
| Stabilizer STAB-2 | $3 \times 10^{-4}$ mole/mol AgX |
| Stabilizer STAB-3 | $3 \times 10^{-4}$ mole/mol AgX |
| Sensitizing dye 3-4 | $1.5 \times 10^{-4}$ mole/AgX |

Samples 303 and 304 were prepared in the same manner as Sample 302, except that the infrared coupler contained in the 6b-th layer was changed as follows.

| Sample No. | Coupler used in 6b-th Layer | ($g/m^2$) |
|---|---|---|
| 302 (Inv) | Infrared coupler (II-15) | 0.27 |
| 303 (Inv) | Magenta coupler (M-1) | 0.10 |
| 304 (Inv) | Yellow coupler (Y-1) | 0.07 |

-continued

| Sample No. | Coupler used in 6b-th Layer | (g/m$^2$) |
|---|---|---|
| | Magenta coupler (M-1) | 0.10 |
| | Cyan coupler (C-1) | 0.07 |

Picture taken and processed Sample 103 prepared in Example 1 was printed on color paper of Samples 3-1 to 304, using enlarger Chromega, by adjusting color balance so that gray color having 18% reflectance was reproduced as gray color; and then subjected to color paper processing (CPK-2-21 availablre from Konica Corp.). These prints were evaluated and results thereof are shown in Table 2.

TABLE 2

| Sample No. | Tree's green | Blue sky | Distant mountain | Sensory assess point (Av. of 10 members) |
|---|---|---|---|---|
| 301 (Comp.) | D | C | D | 3.6 |
| 302 (Inv.) | B | B | B | 4.2 |
| 303 (Inv.) | A | A | B | 4.6 |
| 304 (Inv.) | B | B | A | 4.5 |

As can be seen from the Table, it was shown that according to the invention, there were obtained color prints with superior color tone of green trees and plants, and blue sky; and superior three dimensional realism with respect to distant mountain view.

Example 4

Image information of processed Sample 105 of Example 2, which was subjected to Processing II without bleaching, was read with a scanner to obtain a red component information (R), green component information (G), blue component information (B) and infrared component information (X). Using a modified Konica CRT printer enabling to write with infrared light (780 nm) and without mixing the RGB informations with the X information, color papers of Sample 301 to 304 of example 3 were each subjected to conventional RGB exposure, followed by infrared light exposure of the X information, and further subjected to color paper processing (CPK-2-21 available from Konica Corp.) to obtain print samples 1 to 4.

Furthermore, with respect the image informations described above, the infrared image information was mixed with the green image information according to aforementioned Formula (A). Using the CRT printer capable of writing with infrared light, color paper Sample 302 of Example 3 was subjected to mixed RGB exposure, followed by infrared light exposure of the X information to obtain print sample 5. Evaluation results of obtained prints are shown in Table 3

TABLE 3

| Sample No. | Tree's green | Red tulip | Distant mountain | Sensory assess point (Av. of 10 members) |
|---|---|---|---|---|
| 1 (Comp.) | D | C | D | 3.4 |
| 2 (Inv.) | B | B | B | 4.0 |
| 3 (Inv.) | A | C | B | 4.1 |
| 4 (Inv.) | B | B | A | 4.3 |
| 5 (Inv.) | A | A | A | 4.7 |

As can be seen from the Table, even when extracting the infrared image information from silver image, it was proved that there were obtained effects of the invention, whereby clearness of green trees, rendering of red tulip and three dimensional realism of distant mountains were outputed.

Example 5

From image pick-up system of Konica Digital Still Camera Q-EZ was removed an infrared-cutting filter provided between a CCD and leas. Using this camera, picture of green trees or distant mountains was taken at fixed composition under the following condition 1 or 2.

Condition 1:

An infrared-cutting filter (DR Filter available from Kenko Corp.) was mounted in front of the leas.

Condition 2:

A filter in which visible light was not transmitted and an infrared light at wavelengths of 700 nm or more was transmitted, was mounted in front of the lens.

From a photographing information taken under the condition 1 were extracted R, G and B image informations of the photographic object, and from a photographing information taken under the condition 2 was extracted an infrared image information. Using these four image informations and mixing the G-image information with the infrared image information according to afore-described Formula (A), an image of the invention was obtained through adjusting luminance and chroma. Separately, a comparative image was obtained from R, G and B image informations taken under the condition 1. Both images were compared on a CRT monitor. As a result, the inventive image was superior in clearness of greenish color of trees and tree-dimensional rendering of the distant view. In the comparative image, rendering according to the invention could not achieved even by adjusting chroma or contrast.

What is claimed is:

1. An image forming method comprising:

exposing a photosensitive functional element having a red-sensitive function, a green-sensitive function, a blue-sensitive function and an invisible light-sensitive function to obtain an R image information, a G image information, a B image information and an invisible image information, mixing said invisible image information and an RGB visible image information comprised of said R image information, said G image information and said B image information to form a mixed image information, and outputting the mixed image information.

2. The image forming method of claim 1, wherein said photosensitive element is a silver halide light sensitive color photographic material (1) comprising a support having thereon photographic component layers including a red-sensitive layer, a green-sensitive layer, a blue-sensitive layer and an invisible light-sensitive layer.

3. The image forming method of claim 2, wherein the outputted image information is a visible image information.

4. The image forming method of claim 2, wherein said invisible light-sensitive layer contains a coupler capable of forming an invisible image dye upon reaction with an oxidation product of a color developing agent.

5. The image forming method of claim 4, wherein said invisible light-sensitive layer is an infrared-sensitive layer and said invisible image dye being an infrared absorption dye.

6. The image forming method of claim 2, wherein said red-sensitive layer contains a cyan dye forming coupler.

7. The image forming method of claim 2, wherein said green-sensitive layer contains a magenta dye forming coupler.

8. The image forming method of claim 2, wherein said blue-sensitive layer contains a yellow dye forming coupler.

9. The image forming method of claim 2, wherein said RGB visible image information or said invisible image information is formed with a dye image and a silver image.

10. The image forming method of claim 2, wherein said silver halide color photographic material comprises including a red-sensitive layer containing a cyan dye forming coupler, a green-sensitive layer containing a magenta dye forming coupler, a blue-sensitive layer containing a yellow dye forming coupler and an invisible light-sensitive layer which is an infrared-sensitive layer containing an infrared absorption dye forming coupler; said RGB visible image information or said invisible image information being formed with a dye image and a silver image.

11. The image forming method of claim 2, wherein the exposed photographic material is further subjected to processing to obtain said R image information, G image information, B image information and invisible image information.

12. The image forming method of claim 1, wherein said mixing is electrically performed.

13. The image forming method of claim 1, wherein said mixed image information is outputted onto a silver halide light sensitive color photographic material (2).

14. The image forming method of claim 2, wherein said mixed image information is outputted onto a silver halide light sensitive color photographic material (2).

15. The image forming method of claim 1, wherein said mixed image information is outputted by an electric image outputting means.

16. The image forming method of claim 15, wherein said mixed image information is outputted by allowing a colorant to be transferred onto a support.

17. The image forming method of claim 2, wherein said mixed image information is outputted by an electric image outputting means.

18. The image forming method of claim 17, wherein said mixed image information is outputted by allowing a colorant to be transferred onto a support.

19. The image forming method of claim 13, wherein said mixed image information is outputted by means of scanning exposure onto a silver halide light sensitive color photographic material (2).

20. The image forming method of claim 14, wherein said mixed image information is outputted by means of scanning exposure onto a silver halide light sensitive color photographic material (2).

21. The image forming method of claim 19, wherein said silver halide color photographic material (2) contains a coupler capable of forming an invisible image dye upon reaction with an oxidation product of a color developing agent.

22. The image forming method of claim 19, wherein said silver halide color photographic material (2) has an invisible light-sensitive layer.

23. The image forming method of claim 22, wherein said silver halide color photographic material (2) has an infrared-sensitive layer.

24. The image forming method of claim 23, wherein said silver halide color photographic material (2) contains a coupler capable of forming an infrared absorption dye upon reaction with an oxidation product of a color developing agent.

25. The image forming method of claim 2, wherein said R-image information, said G-image information, said B-image information and said invisible image information each are obtained by an electrically reading means.

26. The image forming method of claim 1, wherein said photosensitive element is an image pick-up device having a charge coupled device.

* * * * *